US006941775B2

(12) United States Patent
Sharma

(10) Patent No.: US 6,941,775 B2
(45) Date of Patent: Sep. 13, 2005

(54) TUBULAR KNIT FABRIC AND SYSTEM

(75) Inventor: Vikram Sharma, Stoneham, MA (US)

(73) Assignee: Electronic Textile, Inc., Stoneham, MA (US)

( * ) Notice: Subject to any disclaimer, the term of this patent is extended or adjusted under 35 U.S.C. 154(b) by 275 days.

(21) Appl. No.: 10/408,641

(22) Filed: Apr. 7, 2003

(65) Prior Publication Data

US 2003/0224685 A1 Dec. 4, 2003

Related U.S. Application Data

(60) Provisional application No. 60/370,179, filed on Apr. 5, 2002.

(51) Int. Cl.[7] ..... A61B 5/04
(52) U.S. Cl. ..... 66/202; 66/171; 2/902
(58) Field of Search ..... 66/202, 169 R, 66/170–171, 172 E, 175–177, 194–198; 600/388, 390–391; 2/902, 905, 102

(56) References Cited

U.S. PATENT DOCUMENTS 4,753,088 A * 6/1988 Harrison et al. ..... 66/202
5,636,378 A * 6/1997 Griffith ..... 2/455
5,687,587 A * 11/1997 Michel ..... 66/196
6,145,551 A * 11/2000 Jayaraman et al. ..... 139/387 R
6,160,246 A 12/2000 Rock et al. ..... 219/545
6,215,111 B1 4/2001 Rock et al. ..... 219/545
6,307,189 B1 10/2001 Rock et al. ..... 219/545
6,341,504 B1 * 1/2002 Istook ..... 66/172 E
6,373,034 B1 4/2002 Rock et al. ..... 219/545
6,381,482 B1 * 4/2002 Jayaraman et al. ..... 600/388
6,414,286 B2 * 7/2002 Rock et al. ..... 219/545
6,501,055 B2 12/2002 Rock et al. ..... 219/545
6,854,296 B1 * 2/2005 Miller, III ..... 66/190

* cited by examiner

*Primary Examiner*—Danny Worrell
(74) *Attorney, Agent, or Firm*—Iandiorio & Teska

(57) ABSTRACT

A tubular knit fabric comprising at least one insulative yarn, at least one stretchable yarn, and at least one functional yarn, the insulating yarn, the stretchable yarn, and the functional yarn knitted together to define a tubular fabric sleeve having the functional yarn embedded in the tubular fabric sleeve in a continuous spiral configuration which longitudinally extends the length of the sleeve.

57 Claims, 15 Drawing Sheets

CUT

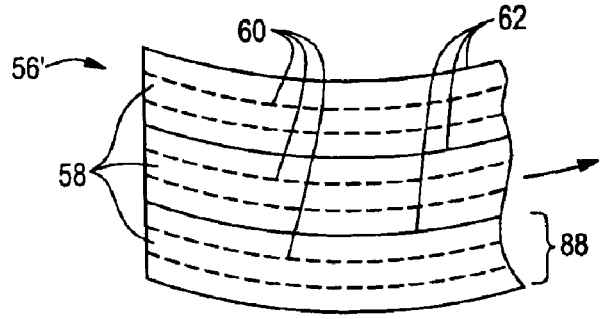
FIG. 8A
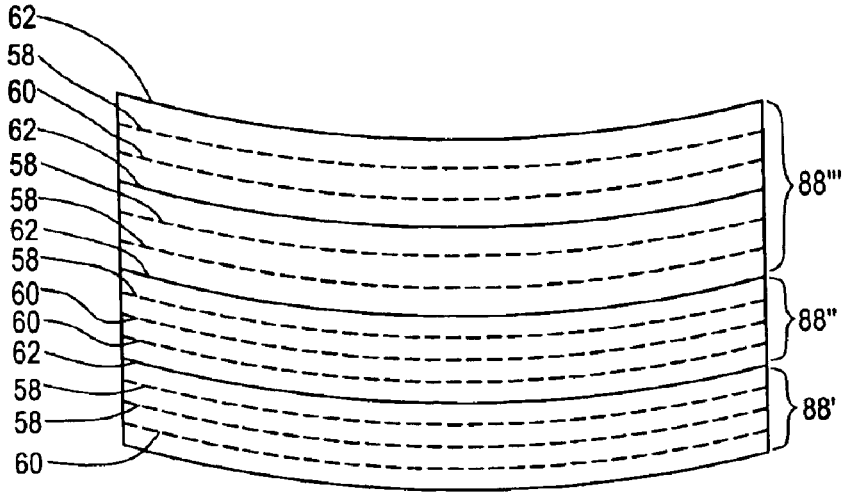
FIG. 8B
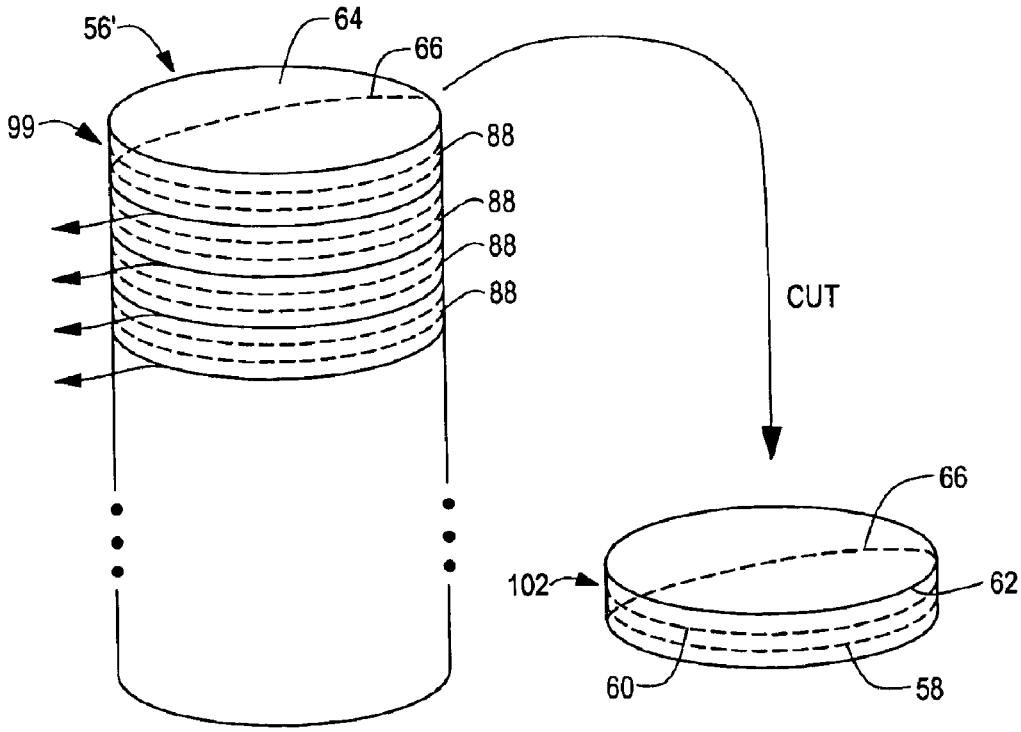
FIG. 9A
FIG. 9B

TUBULAR KNIT FABRIC AND SYSTEM

RELATED APPLICATIONS

This application claims priority of Provisional Application No. 60/370,179 filed Apr. 5, 2002, incorporated by reference herein.

FIELD OF THE INVENTION

This invention relates to knitted fabrics and more particularly to a tubular knit fabric and system.

BACKGROUND OF THE INVENTION

Fabrics with intelligence capabilities, such as the ability to monitor physiological body vital signs, or fabrics used to warm or heat the body (e.g., electric blankets), require conductive elements to be embedded in the fabric. Typical conventional fabrics weave or knit the conductive elements into the fabric. Weaving interlaces the weft threads (the horizontal threads) and the warp threads (lengthwise, or perpendicular to the weft) on a loom, while knitting intertwines yarn or thread in a continuous series of connected needle loops on a machine.

U.S. Patent No. 6,145,551, incorporated by reference herein, discloses a weaving process to produce a woven garment with intelligence capability by weaving non-elastic conductive fibers, such as wires made of copper, stainless steel, and the like, or plastic optical fibers into the fabric. Because the non-elastic conductive wires or fibers are woven into the fabric, the fabric has little or no elongation capability. Hence, any garment produced from this fabric cannot stretch and therefore lacks a tight, body conforming fit. Attaching sensors (e.g., electrodes) related to the monitoring of physiological body vital signs to the loose fitting garment produced from this design results in inaccurate readings because the garment lacks tight closure to the body. Because this fabric is constructed by weaving a series of conductive wefts and warps the embedded conductive wires are employed in a grid configuration. The grid design suffers from the distinct drawback that electrical insulation is required at all the cross points of the grid to prevent electrical short circuiting. Moreover, the weaving machine, or loom employed to produce this fabric is very cumbersome and expensive.

U.S. Patent No.6,381,482, incorporated by reference herein, produces a woven or knitted fabric with an electrical conductive component which may be used for intelligence capabilities. In one design of the '482 patent, a knitted construction is used with conductive wires in-laid between a series of connected needle loops of the yarn. Because the in-laid wires are non-elastic, this type of knit construction, similar to the above, produces a garment which lacks a tight, body conforming fit. The '482 patent also utilizes only insulated electrical wire (e.g., insulated with PVC or polyethylene) which further adds to the rigidity and poor bending capabilities of the garment, resulting in a rigid, stiff fitting, uncomfortable garment which further reduces the accuracy of sensors connected to the conductive elements of the garment.

U.S. Patent Nos. 6,501,055, 6,414,286, 6,373,034, 6,307,189, 6,215,111, and 6,160,246, all incorporated by reference herein, hereinafter "the Maiden Mills patents", disclose electric heating/warming fabric articles employed in electric blankets. The fabrics produced by the Malden Mills patents utilize a tubular knit construction, wherein a fabric body is produced which includes a technical face formed by the stitch yarn and a technical back formed from the loop yarn in a reverse plated knit construction. The process is designed to raise the yarn on both sides of the technical face and/or technical back without breaking the conductive wires. Electrical resistance heating elements (e.g., conductive wires) are incorporated in the tubular fabric as a part of the stitch yarn at a predetermined spacing from each other. Because the electric blankets manufactured by the Maiden Mills patents require thermal and electrical insulative properties, the fabric body is raised by napping, sanding, or brushing to generate fleece. The napping process requires the tubular knit fabric to be cut longitudinally in order to nap the technical face and/or technical back. Incorporation of stretchable yarn into the Malden Mills patent, which utilizes wire brushes and the like, would destroy any conductive material incorporated into the fabric. Hence, the fabric of the Malden Mills patents lacks any significant stretching capabilities. The napping process also obstructs access to the conductive wires incorporated into the fabric thus preventing easy attachment of sensors to the conductive wires. Moreover, longitudinally cutting the tubular fabric also destroys the continuity of the embedded conductive wires which results in the requirement of a bus to interconnect the conductive elements. Furthermore, the Maiden Mills patents cannot manufacture body size or seamless garments.

SUMMARY OF THE INVENTION

It is therefore an object of this invention to provide an improved tubular knit fabric.

It is a further object of this invention to provide such a tubular knit fabric which includes a continuous conductive yarn and can stretch both longitudinally and radially.

It is a further object of this invention to provide such tubular knit fabric which can be used to manufacture a tight fitting and body conforming garment.

It is a further object of this invention to provide such a tubular knit fabric which is comfortable to wear.

It is a further object of this invention to provide such a tubular knit fabric in which sensors attached to conductive component of the fabric are more accurate and reliable.

It is a further object of this invention to provide a tubular knit fabric which eliminates the need for a grid of conductive elements.

It is a further object of this invention to provide such a tubular knit fabric which can be used to manufacture a garment without longitudinally cutting the tubular fabric.

It is a further object of this invention to provide such a tubular knit fabric which eliminates the need for a bus.

It is a further object of this invention to provide such a tubular knit fabric which provides unobstructed access to the continuous conductive element of the fabric.

This invention results from the realization that a truly innovative tubular knit fabric, which can stretch both longitudinally and radially can be used to manufacture a comfortable, tight fitting, body-conforming garment which improves the accuracy of sensors attached to the garment, can be achieved by knitting an insulating yarn, a stretchable yarn, and a functional yarn (e.g., a conductive yarn) in a plated knit construction to define a tubular fabric sleeve and/or a seamless body sized garment having the functional yarn embedded in the tubular fabric sleeve in a unique continuous spiral configuration which extends the longitudinal length of the sleeve; the function yarn may be spaced in predetermined locations and the fabric is plated such that the insulative yarn is on one or both sides of the functional yarn.

This invention features a tubular knit fabric comprising at least one insulative yarn, at least one stretchable yarn, and at least one functional yarn, the insulating yarn, the stretchable yarn, and the functional yarn knitted together to define a tubular fabric sleeve having the functional yarn embedded in the tubular fabric sleeve in a continuous spiral configuration which longitudinally extends the length of the sleeve.

In one embodiment, the functional yarn is an electrically conductive yarn. The conductive yarn may be made of a material chosen from the group consisting of stainless steel, copper, alloy, copper plated with silver, core clad, a kevlar core, a filament core coated with silver, and conductive polymer. The conductive yarn may have an electrical resistance of 0.01 ohm/meter to 5,000 ohm/meter. The insulative yarn may be made of synthetic fibers and/or natural fibers and/or regenerated fibers made of a material chosen from the group consisting of polyester, nylon, wool, rayon, cotton, silk, linen, polypropylene and acrylic. The stretchable yarn may be made of a material chosen from the group consisting of spandex, LYCRA®, and DOW® XLA. The fabric may stretch longitudinally and radially. The fabric may be used to manufacture a garment. The garment may be seamless. The functional yarn may be spaced in a predetermined spacing in a predetermined section of the garment. The garment may be chosen from the group consisting of shirt, pants, jacket, bra, underwear, sock, stocking, knee brace, and/or arm brace, and/or leg brace. The seamless garment may be chosen from the group consisting of shirt, pants, jacket, bra, underwear, sock, stocking, knee brace, and/or arm brace, and/or leg brace. The tubular knit fabric may further include a plurality of insulative yarns, a plurality of the stretchable yarns, and a plurality of the functional yarns. The plurality of insulative yarns, the plurality of stretchable yarns, and the plurality of conductive yarns may be knitted together in a repeating pattern to define the tubular fabric sleeve, the pattern including at least one functional yarn per pattern. The plurality of insulative yarns, the plurality of stretchable yarns, and the plurality of conductive yarns may be knitted together in a plated knit construction on at least one side of the tubular knit fabric. The plurality of insulative yarns, the plurality of stretchable yarns, and the plurality of conductive yarns may be knitted together in a plated knitted construction on both sides of the fabric, the fabric having an insulated yarn in between the stretchable yarn and the conductive yarn. The plated knit construction may be chosen from the group consisting of single jersey, double-knit and ribs. The tubular fabric sleeve may be body sized. The tubular knit fabric of claim 14 wherein the tubular fabric sleeve is body sized. The pattern is a symmetric pattern of the plurality of insulative yarns, stretchable yarns and functional yarns. The pattern may be an asymmetric pattern of the plurality of insulative yarns, stretchable yarns and functional yarns. The plurality of the functional yarns may be electrically conductive yarns. The tubular fabric sleeve may be radially cut to form a narrow band of tubular fabric. The narrow band of tubular fabric may be attached to a garment. The narrow band attached to a garment may be chosen from the group consisting of a bra, running pants, shirts, underwear, socks, a hat, gloves, stocking, orthopedic support braces for the arms and legs. The seamless garment may be knitted on a seamless knitting machine. The functional yarn may be used to transmit signals, as a power pathway, may be used for generating heat, for thermoelectric cooling, or as a rechargeable battery.

This invention further features a tubular knit fabric system, the system including at least one insulative yarn, at least one stretchable yarn, at least one conductive yarn, the insulating yarn, the stretchable yarn, and the conductive yarn knitted together to define a tubular fabric sleeve having the conductive yarn embedded in the tubular fabric sleeve in a continuous spiral configuration which longitudinally extends the length of the sleeve, and a device connected to the conductive yarn. The sensor may be used to measure physiological signs of the body. The physiological signs measured may be chosen from the group consisting of heart rate, blood pressure, heart abnormalities, sweat rate, basal metabolic rate and temperature. The sensor may be a conductive electrode, and/or an electrical circuit. The conductive patch may be made of a material chosen from the group consisting of resin, resin with embedded conductive particles, metal, copper, alloys, conductive rubber, and conductive epoxies. The device connected to the conductive yarn may be chosen from the group consisting of a heart rate measuring device, a blood pressure measuring device, a temperature measurement device, a sweat measurement device, a basal metabolic measuring device, an activity measurement device, a hydration measurement device, or a congnitivity measuring device. The terminals may be connected at the end of the conductive yarn. The electronic unit may be connected to the terminals, the electronic unit communicating to the device connected to the conductive yarn. The electronic unit connected to the terminal may be chosen from the group consisting of a heart rate measuring device, a blood pressure measuring device, a temperature measurement device, a sweat measurement device, a basal metabolic measuring device, an activity measurement device, a hydration measurement device, or a congnitivity measuring device. The electric unit may be connected to a garment by conductive rubber and/or sewing, and/or mechanical snaps or combination thereof. The system may further include a plurality of devices connected to the conductive yarn. The system may further include a plurality of devices connected to a plurality of conductive yarns. The plurality of sensors may be located on the right side of a garment and another of each the plurality of sensors may be located on the left side of a garment for heart rate monitoring. The plurality of sensors may be located on the top of a garment and another of the plurality of sensors may be located on the bottom of a garment. The garment may be chosen from the group consisting of a bra, running pants, shirt, underwear and socks, a hat, gloves, orthopedic brace, stocking and swimsuits. The tubular fabric sleeve having the conductive yarn embedded in the tubular fabric sleeve in a continuous spiral configuration which longitudinally extends the length of the sleeve, may be radially cut and orientated in the garment such that the continuous spiral configuration extends vertically along the length of the garment.

This invention further features an integrated data and power bus including at least one insulative yarn, at least one stretchable yarn, and at least one functional yarn, the insulating yarn, the stretchable yarn, and the functional yarn knitted together to define a tubular fabric sleeve having the functional yarn embedded in the tubular fabric sleeve in a continuous spiral configuration which longitudinally extends the length of the sleeve.

This invention also features a tubular knit fabric including at least one insulative yarn, at least one stretchable yarn, and at least one functional yarn, the insulating yarn, the stretchable yarn, and the functional yarn knitted together to define a tubular fabric sleeve, having functional yarn embedded the tubular fabric sleeve in a continuous spiral configuration which longitudinally extends the length of the sleeve; the tubular fabric sleeve radially cut and orientated such that the continuous spiral configuration extends vertically along the length of a garment.

This invention further features a tubular knit fabric including at least one insulative yarn, at least one stretchable yarn, and at least one functional yarn, the insulating yarn, the stretchable yarn, and the functional yarn knitted together in a plated knit construction to define a tubular fabric sleeve having the functional yarn embedded in the tubular fabric sleeve in a continuous spiral configuration which longitudinally extends the length of the sleeve.

This invention further features a tubular knit fabric including at least one insulative yarn, at least one stretchable yarn, and at least one functional yarn, the insulating yarn, the stretchable yarn, and the functional yarn knitted together in a plated knit construction to define a seamless tubular fabric sleeve having the functional yarn embedded in the tubular fabric sleeve in a continuous spiral configuration which longitudinally extends the length of the seamless tubular fabric sleeve.

This invention also features a method for manufacturing a tubular knit fabric, the method including the steps of providing at least one insulative yarn, providing at least one stretchable yarn, providing at least one functional yarn, and knitting the insulative yarn, the stretchable yarn and the functional yarn together to define a tubular fabric sleeve having functional yarn embedded the tubular fabric sleeve in a continuous spiral configuration which longitudinally extends the length of the sleeve.

This invention also features a method for manufacturing an integrated seamless knit garment, the method including the steps of providing at least one insulative yarn, providing at least one stretchable yarn, providing at least one functional yarn, and knitting the insulative yarn, the stretchable yarn and the functional yarn together on a seamless knitting machine having plated knit construction with functional yarn incorporated in a predetermined spacing and a predetermined location in the seamless garment.

BRIEF DESCRIPTION OF THE DRAWINGS

Other objects, features and advantages will occur to those skilled in the art from the following description of a preferred embodiment and the accompanying drawings, in which:

FIG. 8A is a schematic side view showing an exemplary repeating symmetrical pattern having the same number of insulative yarns, stretchable yarns, and functional yarns of the tubular knit fabric shown in FIG. 6;

FIG. 8B is a schematic side view showing an exemplary repeating asymmetrical pattern having a different number of insulative yarns, stretchable yarns, and functional yarns of the tubular knit fabric of this invention;

FIG. 9A is a schematic three-dimensional view showing how the tubular knit fabric of this invention may be cut radially to produce a narrow band of the tubular fabric;

FIG. 9B is a three-dimensional schematic view of the narrow band of tubular knit fabric cut from the tubular knit fabric shown in FIG. 9A;

DISCLOSURE OF THE PREFERRED EMBODIMENT

Figure 2:
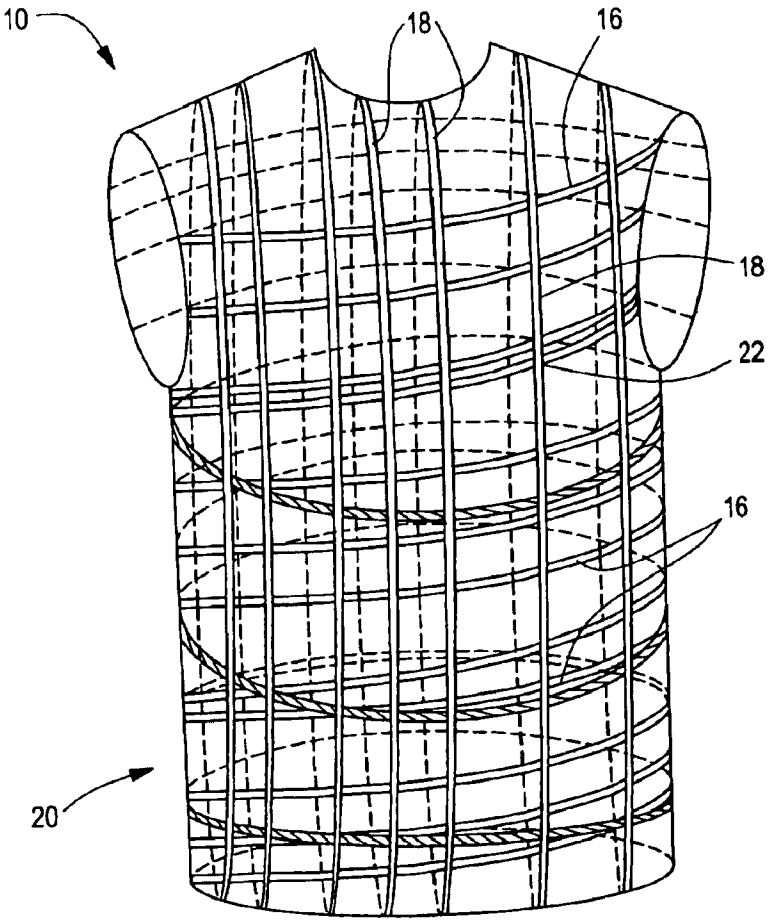
FIG. 2 PRIOR ART
FIG. 2 is three-dimensional view of the prior art shirt shown in FIG. 1 incorporating a grid design of conductive elements.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings.

Figure 1:
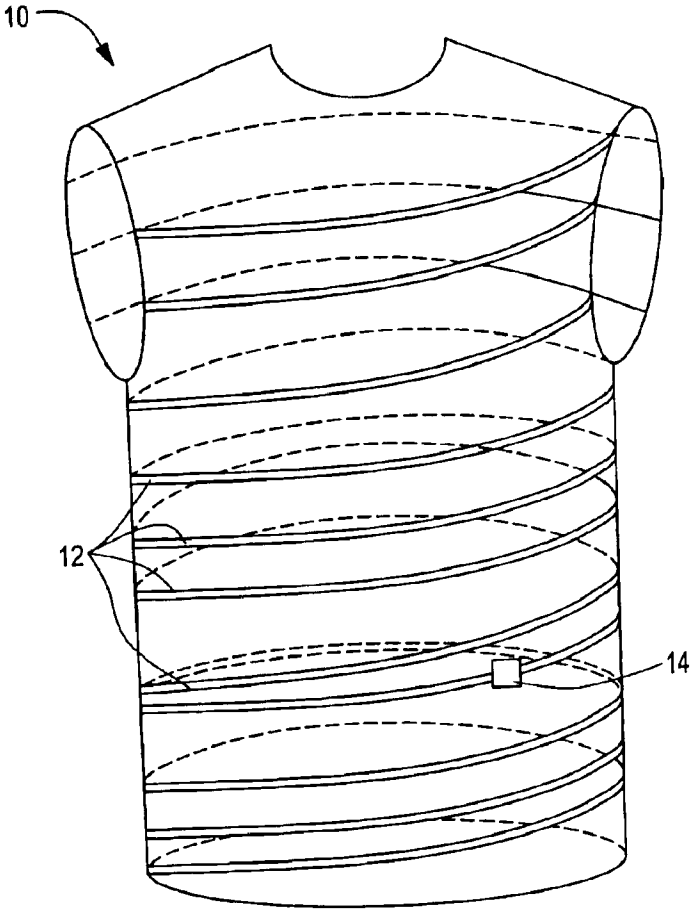
FIG. 1 PRIOR ART
FIG. 1 is a schematic three-dimensional view of a prior art woven fabric showing separate radial conductive elements embedded in a shirt.

As delineated in the Background, the '551 patent discloses a weaving process which produces woven garment 10, FIG. 1 with intelligence capability by weaving non-elastic conductive fibers 12, made of a material such as copper, stainless steel, and the like, or plastic optical fibers into garment 10. A distinct drawback of this design is that the non-elastic conductive fibers 12 have little or no elongation capability, hence garment 10 cannot stretch to provide a tight fitting, body conforming garment. Because of the loose fit of garment 10, sensor 14 provides inaccurate and less reliable measurements.

Moreover, garment 10, FIG. 2 is typically manufactured by weaving wefts and warps of conductive fibers 16 and 18, respectfully, to produce grid 20. Grid 20 suffers from the distinct disadvantage that electrical insulation is required at all the cross-points of conductive fibers 16 and 18, such as the cross-point indicated at 22, to prevent electrical shorting of conducting fibers 16 and 18.

Figure 3:
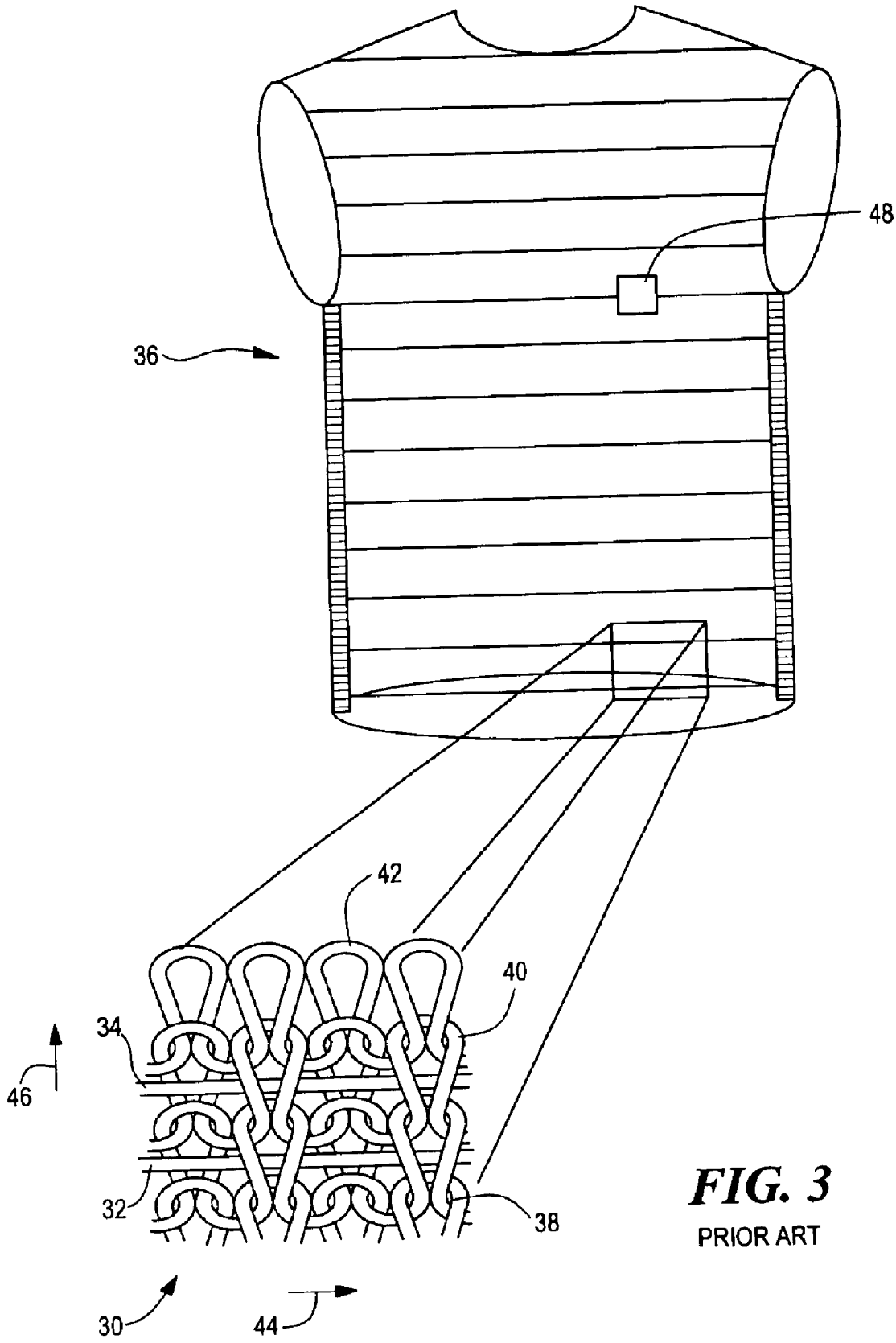
FIG. 3 PRIOR ART
FIG. 3 is a schematic three-dimensional view of a prior art shirt manufactured using a knitting technique which utilizes in-laid wires between a series of needle loop yarns.

Prior art fabric 30, FIG. 3 as disclosed in the '482 patent attempts to overcome shortcomings associated with weaving by knitting conductive elements 32 and 34 (e.g., copper or stainless steel wire and/or plastic optical fibers) into fabric 30 of garment 36 (e.g., a shirt). As shown in the exploded view of FIG. 3, conductive elements 32 and 34 are in-laid between needle loop yarns 38, 40 and 42. Because in-laid conductive elements 32 and 34 are non-elastic, fabric 30 cannot stretch radially as indicated by arrow 44. Moreover, in-laid conductive elements 32 and 34 limit the ability of fabric 30 to stretch longitudinally, as indicated by arrow 46, even with the incorporation of spandex yarn (e.g., any of yarns 38, 40, or 42). The result is that garment 36 lacks a tight, body-conforming fit which, as discussed above, reduces the accuracy and reliability of sensor 48. Moreover, the '482 patent utilizes only insulated wires (e.g., PVC or polyethylene) which further increases the rigidity of garment 36, resulting in an uncomfortable, stiff fitting, rigid garment.

Figure 4B:
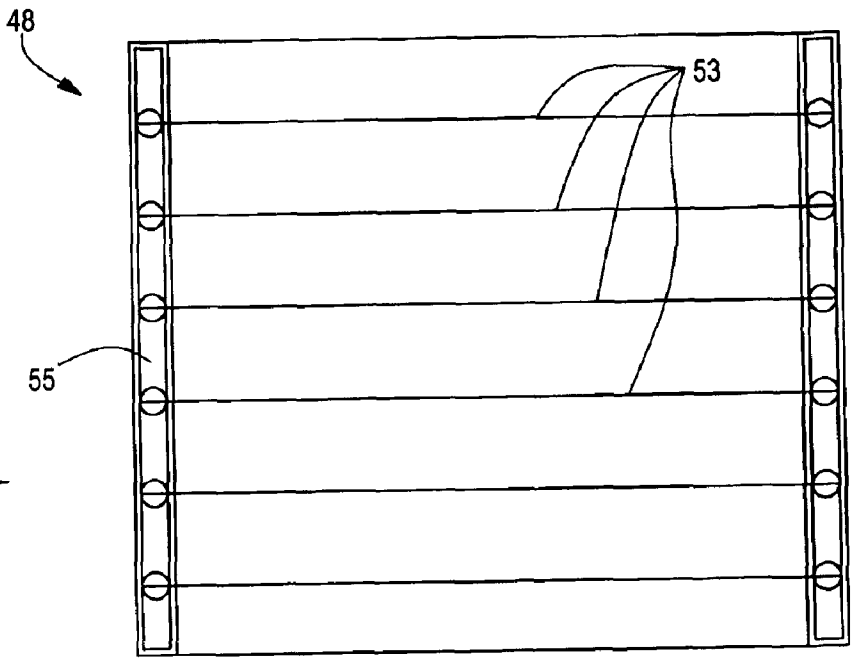
FIG. 4B PRIOR ART
FIG. 4B is a schematic front view after the tubular knit fabric shown in FIG. 4A has been cut longitudinally.
Figure 4A:
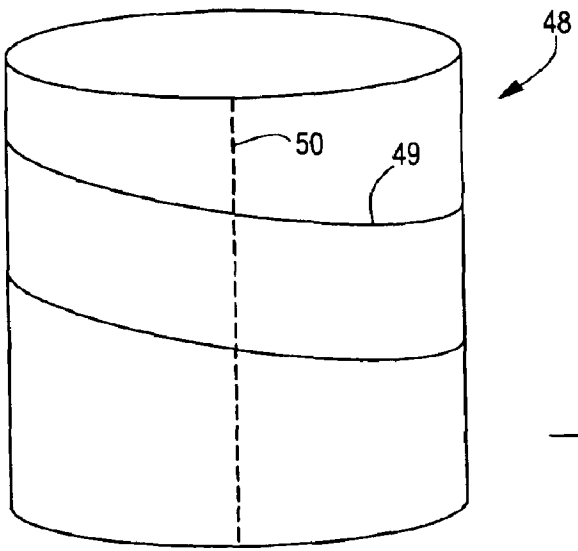
FIG. 4A PRIOR ART
FIG. 4A is a schematic three dimensional view of a prior art tubular fabric used to manufacture electric blankets which is cut longitudinally to nap the fabric.
Figure 4C:
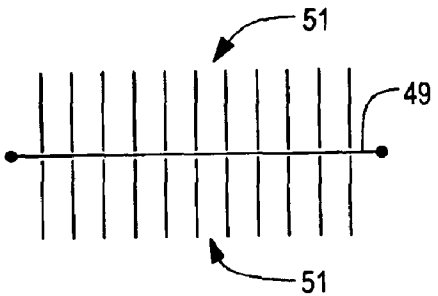
FIG. 4C PRIOR ART
FIG. 4C is a schematic front view of the tubular knit fabric shown in FIG. 4B showing how fleece produced from the napping process obstructs access of the conductive component of the fabric.

As described above, the Maiden Mills patents are used to manufacture electric blankets. Because the electric blankets require insulative properties, the fabric body must be raised by napping to generate fleece. Prior art tubular knit fabric 48, FIG. 4A produced by the Malden Mills patents typically includes conductive yarn 49 (e.g., a wire) used to generate heat for the electric blanket. In order to nap the fabric, tubular knit fabric 48 must be longitudinally cut, as indicated at 50, so that fabric 48 can be laid out, as shown in FIG. 4B and napped. As discussed above, the napping process utilizes wire brushes and the like, to generate fleece 51, FIG. 4C, from the non-conductive yarns. As shown in FIG. 4C, the napping process obstructs access to the conductive yarn 49, hence making the attachment of sensor(s) to conductive yarn 49 very difficult. Moreover, because tubular knit fabric 49 is longitudinally cut, the continuity of the embedded conductive yarn 49, FIG. 4A, is destroyed resulting in series 53, FIG. 4B, of conductive yarns (e.g., heating elements) which must be interconnected by bus 55. As discussed above, the incorporation of stretchable yarn into the Malden Mills patent, which utilizes wire brushes and the like for the napping process, which would destroy any conductive material incorporated into the fabric. The Malden Mills patents cannot manufacture body size or seamless garments. Furthermore, because the napping process of the Malden Mills patents would destroy any stretchable yarns (e.g., LYCRA® or spandex and the like) incorporated into the fabric, knitted fabric 48 cannot employ a stretchable yarn and is incapable of any significant radial or longitudinal stretching and hence cannot be used to manufacture a tight fitting, body conforming garment.

Figure 5A:
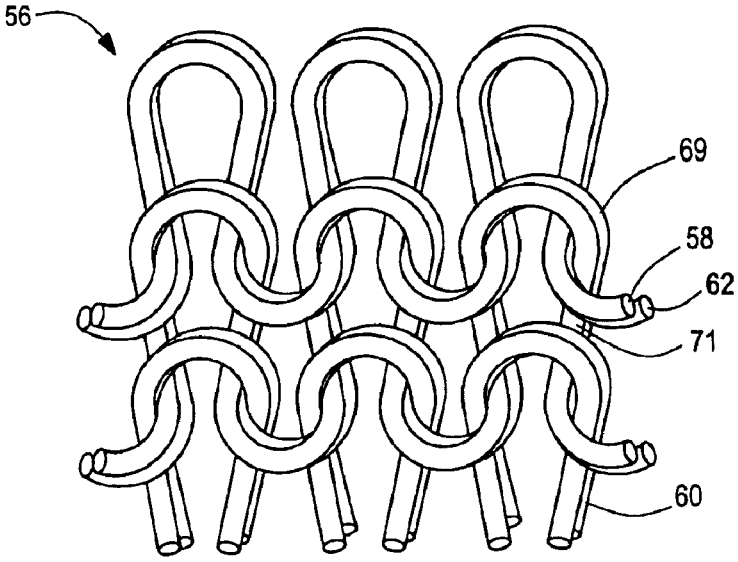
FIG. 5A is a schematic side view of the tubular knit fabric of this invention employing a plated knit construction.
Figure 5B:
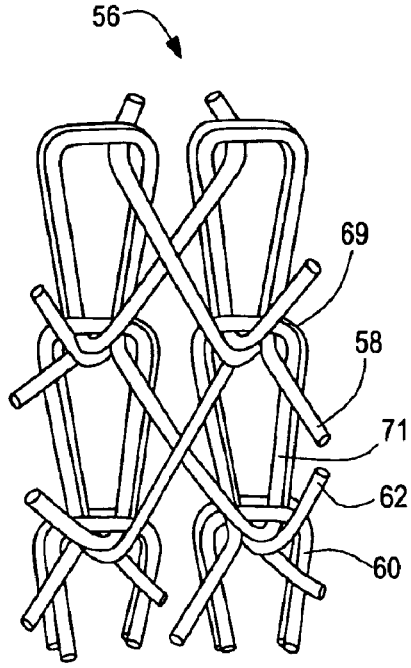
FIG. 5B is a schematic side view of the tubular knit fabric of this invention employing another plated knit construction.
Figure 5C:
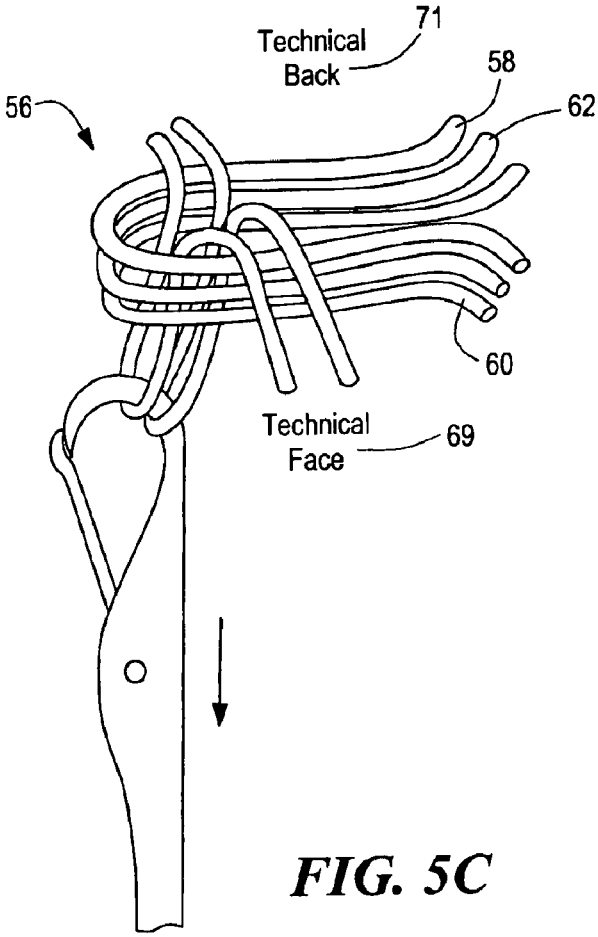
FIG. 5C is a schematic side view of the tubular knit fabric in accordance with this invention showing in detail how the plated knit construction of the insulative yarn, the stretchable yarn and the conductive yarn are knitted on a knitting machine.
Figure 6:
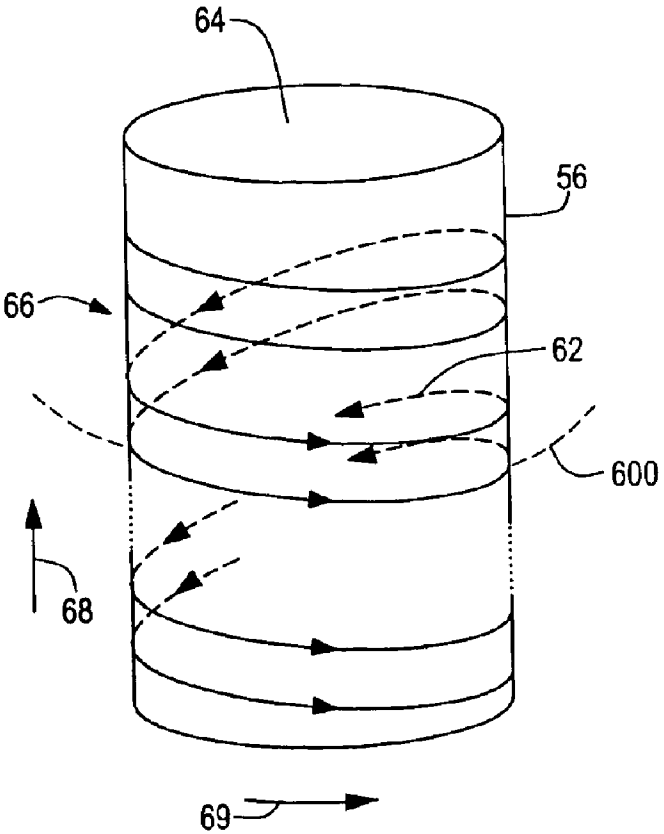
FIG. 6 is a schematic three-dimensional view of one embodiment of the tubular knit fabric of this invention.
Figure 10A:
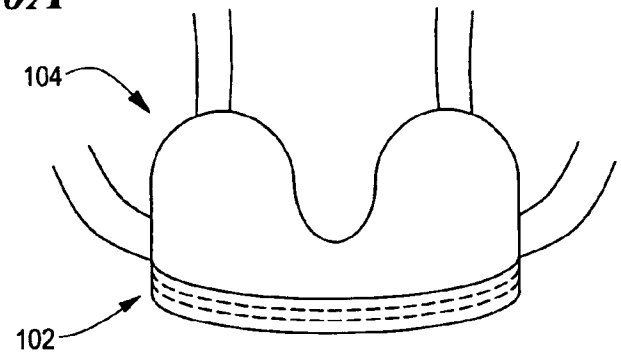
FIG. 10A is a schematic three-dimensional view of the narrow band of tubular fabric shown in FIG. 9B incorporated into a bra.
Figure 10B:
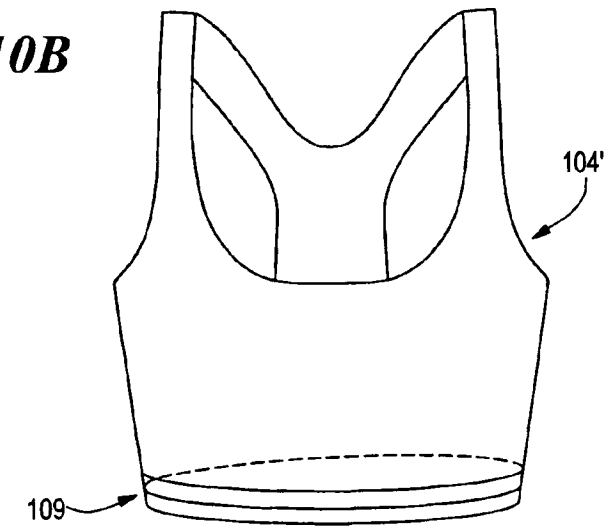
FIG. 10B is a schematic three-dimensional view of a bra manufactured on a seamless knitting machine in accordance with this invention shown the conductive yarn incorporated in the lower part of the bra.
Figure 11A:
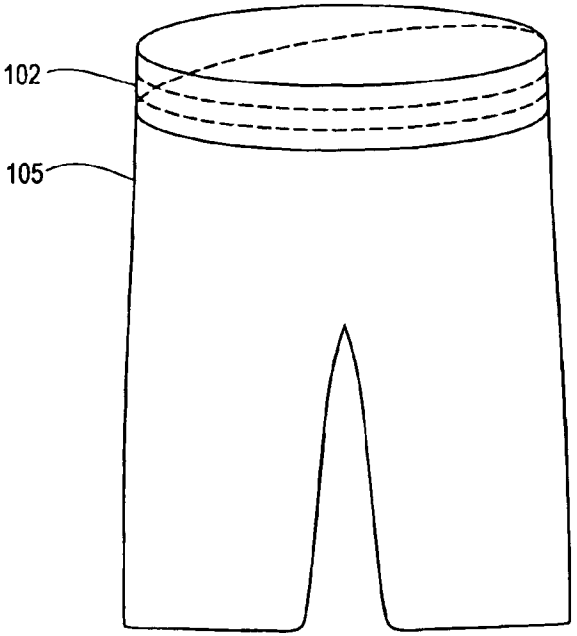
FIG. 11A is a schematic three-dimensional view of the narrow band of tubular fabric shown in FIG. 9B incorporated into a pair of running pants/underwear.
Figure 11B:
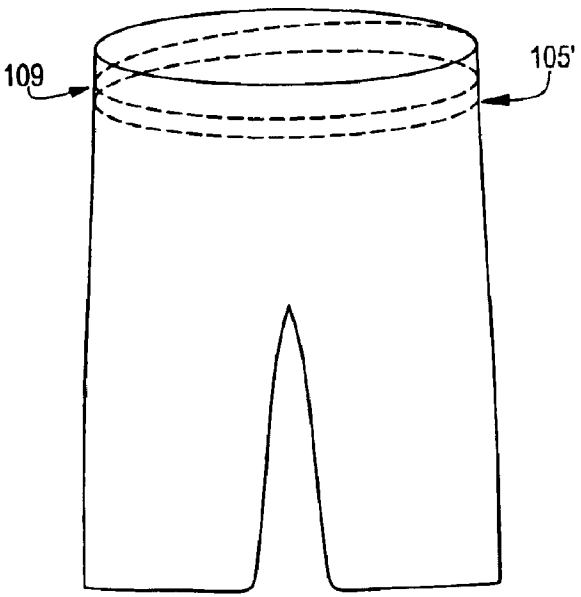
FIG. 11B is a schematic three-dimensional view of a running pants/underwear manufactured on a seamless knitting machine in accordance with this invention showing the conductive yarn incorporated the waistband of the running pants/underwear.

In contrast, tubular knit fabric 56, FIGS. 5A–5C of the subject invention includes at least one insulative yarn 58, at least one stretchable yarn 60, and at least one functional yarn 62 knitted together to define tubular fabric sleeve 64, FIG. 6, having functional yarn 62 embedded in tubular fabric sleeve 64 in continuous spiral configuration 66 which longitudinally extends the length of sleeve 64. In one example, as shown in FIGS. 6, 7, 13, 14, and 15, continuous spiral configuration 66 may extend almost the entire length of tubular fabric sleeve 64 or a considerable portion of the length of tubular fabric sleeve 64. In other examples, as discussed below, continuous spiral configuration 66 may extend only a portion of tubular knit fabric 56, such as shown in FIGS. 10B and 11B. In a preferred embodiment, tubular knit fabric 56, FIGS. 5A–5C is a plated knit construction, such as single jersey, double-knit, or rib. Preferably, the plated construction will have insulating yarn 58 on at least one side of tubular fabric 56 (e.g., on technical back 71 or technical face 69). In other designs, insulative yarn 58 may be on both sides of tubular fabric 56 (e.g., on both technical back 71 and technical face 69). In either design, functional yarn 62 is plated in between technical face 69 and technical back 71. In one design of this invention, stretchable yarn 60 (e.g., spandex) may be on every course of tubular knit fabric 56. In other examples, stretchable yarn 60 may be on every other course of tubular knit fabric 56. Stretchable yarn 60 may be at any desired predetermined spacing and may or may not be in the same course as the functional yarn 62.

Continuous spiral configuration 66 of functional yarn 62 stretches longitudinally, as indicated by arrow 68 and radially as indicated by arrow 69. The inclusion of stretchable yarn 60, FIGS. 5A–5C, improves the longitudinal and radial stretching capability of tubular knit fabric 56. Stretchable yarn 60 also improves recovery properties of tubular knit fabric 56. The result is that any garment manufactured from unique tubular knit fabric 56, FIGS. 5A–5C and 6 is tight fitting and or body size and body conforming which, as will be discussed below, improves the accuracy of any sensor(s) connected to functional yarn 62 (e.g., a conductive yarn). The recovery property of tubular knit fabric 56 helps to retain a tight, body conforming fit.

Tubular knit fabric 56 eliminates the need to weave electrical wires longitudinally and radially in a grid configuration to provide intelligence capabilities (e.g., a network) which, as discussed above, requires insulation at all the cross-points. Instead, functional yarn 62, FIG. 6 is embedded throughout tubular sleeve 64 in continuous spiral configuration 66. The result is the ability to attach a plurality of devices on different functional yarn 62, which are able to communicate to each other via functional yarn 62. Insulative yarn 58 may be knitted on both sides of functional yarn 62 (e.g., along technical face 69, FIGS. 5A–5C and/or technical back 71) to provide electrical insulation, hence eliminating the requirement for insulated conductive yarns as used in the prior art. Stretchable yarn 62 provides the ability for tubular knit fabric 56 to stretch radially and longitudinally. The result is a tight fitting, body conforming garment that can be manufactured from body size tubular knit fabric 56. Because there is no need to cut tubular knit fabric sleeve 64 longitudinally, the requirement for a bus to interconnect the conductive yarns is eliminated. Moreover, because tubular knit fabric 58 is not napped, conductive yarn 62 can be easily accessed for the attachment of sensors.

Figure 7:
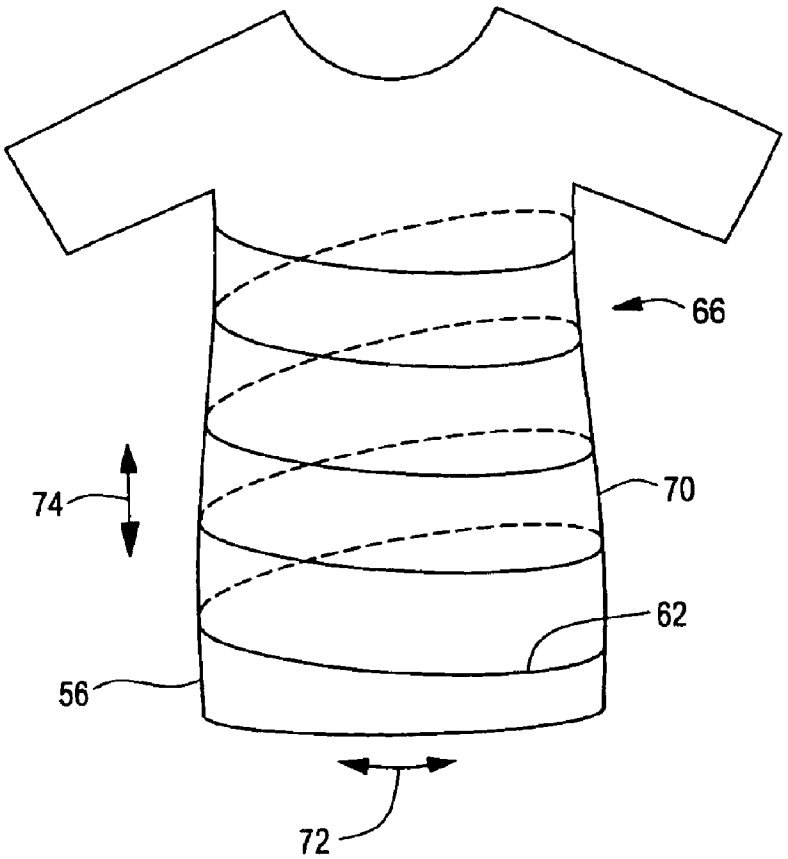
FIG. 7 is a schematic front view of a shirt manufactured from the tubular knit fabric shown in FIG. 6.

Functional yarn 62 is typically an electrically conductive yarn. In one example, the conductive yarn is made of stainless steel, copper, alloy, copper plated with silver, core clad, kevlar core, or any textile yarn coated with silver, or a conductive polymer. Those skilled in the art will recognize that any suitable conductive material may be used to make functional yarn 62. In one example, the electrical resistance of conductive yarn 62 is in the range of about 0.01 ohm/meter to 5,000 ohm/meter. Tubular knit fabric 56 is typically used to manufacture a garment such as a shirt, pants, jacket, underwear, socks and the like. For example, shirt 70, FIG. 7, shows unique conductive spiral configuration 66 of functional yarn 62 longitudinally extending the length of shirt 70. In this example, shirt 70 is body size tight fitting and body conforming because tubular knit fabric 56 of shirt can stretch both radially, as indicated by arrow 72 and longitudinally, as indicated by arrow 74. Attaching a sensor and/or sensors (not shown) as discussed below, to conductive yarn 62 on tight fitting, body conforming shirt 70 improves the accuracy of the sensor(s).

In one design of this invention, tubular knit fabric 56', FIG. 8A, includes a plurality of insulative yarns 58, a plurality of stretchable yarns 60, and a plurality of functional yarns 62. Insulative yarns 58, stretchable yarns 60 and conductive yarns 62 may be knitted together by a knitting machine in symmetrical repeating pattern 88 to define tubular fabric sleeve 64, FIG. 6. Repeating pattern 88 is repeated by a circular knitting machine, such as Monarch or Mayer. The seamless knit construction is typically performed on a Santoni knitting machine. In this example, pattern 88 is a symmetric pattern of the plurality of insulative yarns, stretchable yarns and functional yarns, e.g., it contains the same number of insulative yarns, stretchable yarns and functional yarns per pattern.

Although as shown in FIG. 8A, there is only one insulative yarn 58, one stretchable yarn 60 and one functional yarn 62 per pattern repeat, in other designs of this invention, there may be any number of insulative yarns 58, stretchable yarns 60 and functional yarns 62. For example, asymmetric pattern 88' of tubular knit fabric 56", FIG. 8B contains a different number of conductive yarns, functional yarns, and stretchable yarns per pattern. In this example, pattern 88' includes two insulative yarns 58, one stretchable yarn 60, and one functional yarn 62 (conductive yarn). In another example, pattern 88" is layered as two stretchable yarns 60, one insulative yarn 58, and one functional yarn 62. In another example, pattern 88'" is layered as two insulative yarns 58, one functional yarn 62, one stretchable yarn 60, one insulative yarn 58, and another functional yarn 62. Those skilled in the art will recognize that pattern 88, FIGS. 8A and 8B can have any number of insulative yarns 58, stretchable yarns 60 and conductive yarns 62, layered in any configuration.

Tubular knit fabric 56, FIG. 9A, shows an example of a repeating pattern 88, FIG. 8A of a tubular fabric sleeve 64. Tubular knit construction of tubular knit fabric 56 is ideally a plated knit construction, such as single jersey or double-knit. The plate construction improves electrical insulation, reducing friction, and improves water management. Tubular knit fabric 56' can be radially cut, for example, at the location indicated by arrow 99, to create narrow band 102, FIG. 9B, of tubular knit fabric 56'. Narrow band 102 includes at least one insulative yarn 58, at least one stretchable yarn 60, and at least one functional yarn 62 embedded in a spiral configuration 66 throughout narrow band 102. Narrow band 102 can easily be sewn into various garments to provide for the attachment of sensors, as described in detail below. In one example, narrow band 102 is inserted into bra 104 as shown in FIG. 10. In another example, narrow band 102 is sewn into running pants, underwear 105 as shown in FIG. 11.

In one example of this invention, Bra 104', FIG. 10B and running pants/underwear 105', FIG. 11B are knitted as a whole unit on a seamless knitting machine. In this example, conducting yarn 62 is knitted only in a predetermined section, e.g., the section indicated by arrow 109. Seamless bra 104' or running pants or underwear 105' can be knitted on a Santoni knitting machine (Santoni SPA, Brescia, Italy).

Functional yarn 62, FIGS. 5–11, with the unique continuous spiral configuration 66 which is embedded in tubular fabric sleeve 64 may be used to transmit signals, or as a power pathway, or to generate heat, or for thermoelectric cooling, or as a rechargeable battery, or for the creation of magnetic fields, as is described below.

Figure 12:
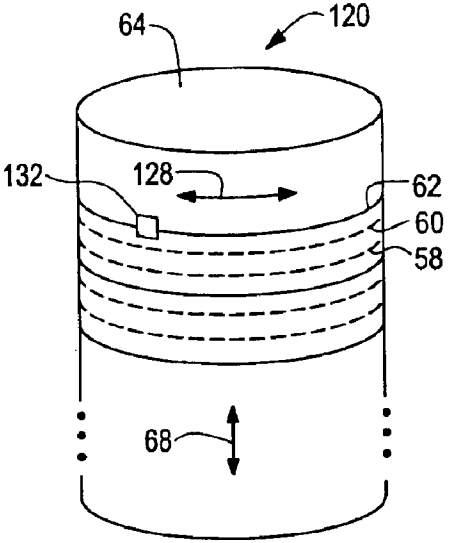
FIG. 12 is a schematic three-dimensional view of one embodiment of the tubular fabric system of the subject invention.

Tubular knit fabric system 120, FIG. 12, includes at least one insulative yarn 58, at least one stretchable yarn 60, and at least one conductive yarn 62. Insulative yarn 58, stretchable yarn 60 and conductive yarn 62 are knitted together to define tubular fabric sleeve 64 having conductive yarn 62 embedded in tubular fabric sleeve 64 in continuous spiral configuration 66, FIG. 13, which longitudinally extends for a length along tubular fabric sleeve 64. System 120, FIGS. 12 and 13, also includes device 132 connected to conductive yarn 62. In one design, device 132 is a sensor and is used to measure and/or monitor physiological signs of the body. Examples of physiological body signs which may be measured by sensor 132 include heart rate, blood pressure, heart abnormalities, body temperature, sweat rate, basal metabolic rate, and the like. Device 132 may be a heart rate measuring device, a blood pressure measuring device, a temperature measurement device, a sweat measurement device, and a basal metabolic measuring device, an activity measurement device, a hydration measurement device, or a congnitivity measuring device. Device 132 may also be used to measure chemicals, toxins, and the like. In one design, device or sensor 132 may be used as an electrode and is made of a conductive patch made of a conductive material such as resin, resin with embedded conductive particles, a metallic plate, or any other suitable sensing material.

Figure 13:
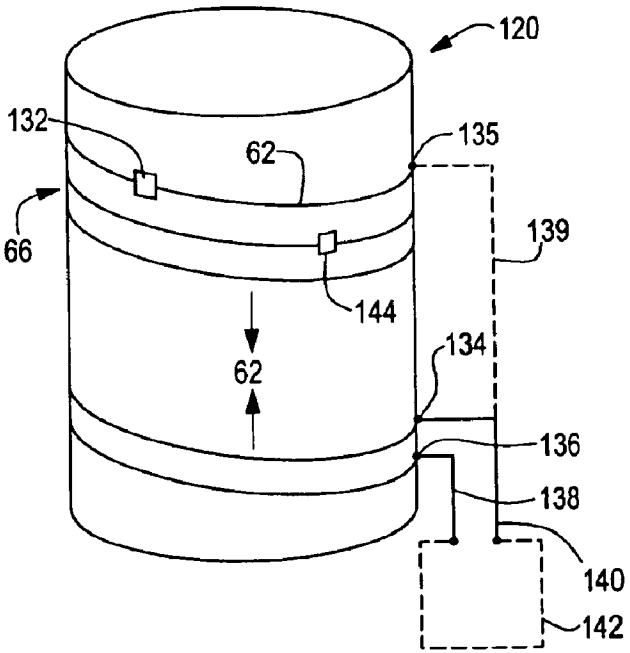
FIG. 13 is a schematic three-dimensional view of the tubular knit fabric system shown in FIG. 12 showing a sensor connected to the continuous spiral configuration of the functional yarn in accordance with the subject invention.

System 120, FIG. 13, may include terminal points 134 and 136 connected on conductive yarn 62. Typically, leads 138 and 140 are attached to terminal points 134 and 136, respectively. In one example, electronic device 142 is connected to leads 138 and 140. In one embodiment, system 120, FIG. 13 may be used for heating. In this design, sensors 132 and 144 are not required. Instead, terminal point 135 and lead 139 are employed, connected at the opposite end of conductive yarn 62 than terminal point 136. Heat is generated by applying power to leads 138 and 139 which sends electricity through the infrastructure of conductive yarn 62 provided by continuous spiral configuration 66. In one example, device 142 is a rechargeable power battery. In other examples, device 142 is a data interpretation device and/or data transfer device and/or an electronic hub device for transmitting or processing of signals from sensor (e.g., device 132). The data may be utilized on a PDA, such as Palm manufactured by Palm Inc. of Milpitas, Calif.

System 120 may include a plurality of devices or sensors, such as sensor 132 and sensor 144 interconnected with conductive yarn 62. In other designs, system 120 may include a plurality of sensors interconnected with different conductive yarns 62. For example, tubular knit fabric system 120', as employed in shirt 180, FIG. 14, includes sensor 182 connected on conductive yarn 181, and sensor 188 connected to conductive yarn 190. In this example, sensor 182 is mounted on the left side of shirt 180 and sensor 188 is mounted on the right side of shirt 180. This unique feature provides the ability for monitoring of physiological body signals of the left and right side of the body which provides useful information in determining heart rate and the like. Sensor 188 is connected to conductive yarn 190 and provides measurement of physiological body signs, or be used to perform other functions such as measurement of temperature, hydration, and/or the physical state of the body. System 120' as employed with shirt 180 includes terminals 196 and 198 with electrical leads 204 and 206, respectively, for the attachment of electrical unit 210 which communicates with sensors or devices 182 and 188 via conductive yarns 181 and 190, conductive yarns 181 and 190 typically end in close proximity to electrical unit 210. Electrical unit or device 210 may be a device used to measure heart rate, temperature, sweat rate, the physical state of the body, and the like, such as a heart rate measuring device, a blood pressure measuring device, a basal metabolic measuring device, a temperature measurement device, a sweat measurement device, an activity measurement device, a hydration measurement device, or a congnitivity measuring device. In one example, electric unit 210 is connected to shirt 180 by conductive rubber and/or sewing, and/or mechanical snaps or any combination thereof. Those skilled in the art will recognize device 210 may be a suitable device used for measuring any physiological vital signs of the body and may be connected to shirt 210 by any suitable means.

Figure 15:
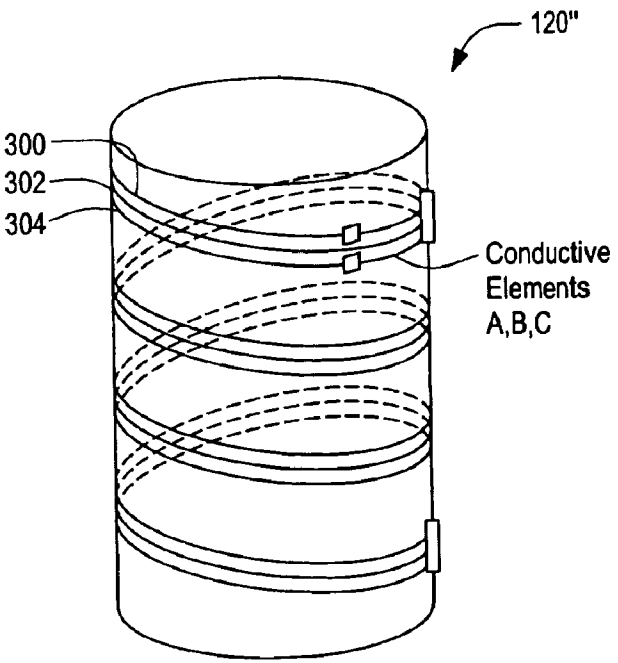
FIG. 15 is a schematic three-dimensional view of the tubular knit fabric system of this invention showing a plurality of conductive yarns utilized to decrease the electrical resistance in the system.
Figure 14:
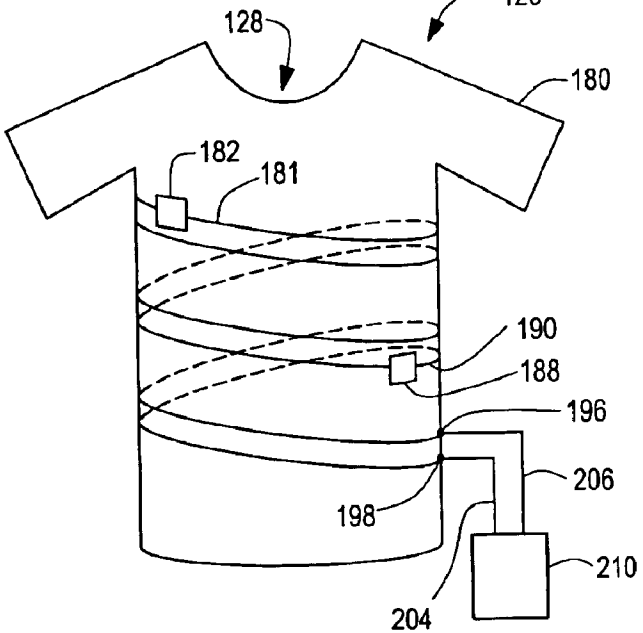
FIG. 14 is a schematic front view of a shirt employing the tubular knit fabric system of this invention.

Tubular knit fabric system 120", FIG. 15 includes plurality of conductive yarns 300, 302, and 304 connected in a parallel configuration. Plurality of conductive yarns 300, 302, and 304 of tubular knit fabric system 120" are connected in parallel in order to decrease the electrical resistance of system 120". The reduction electrical resistance of system 120" is determined by the equations:

$$1/R_{Final} = \frac{1}{R_1} + \frac{1}{R_2} \tag{1}$$

$$R_{Final} \Longrightarrow \frac{R_1 R_2}{R_1 + R_2} \tag{2}$$

where R is the resistance of the conductive yarn, e.g., plurality of conductive yarns 300, 302, and 304. If $R_1=R_2$ and there are n resistances, (e.g., three conductive yarns 300, 302 and 304), then the final resistances of the plurality of conductive yarns equals:

$$R_{Final} = \frac{R_1}{n} \tag{3}$$

where n=number of resistances (e.g., the number of conductive yarns). As shown in equation (3), increasing the number of conductive yarns decreases the electrical resistance of system 120".

Figure 16:
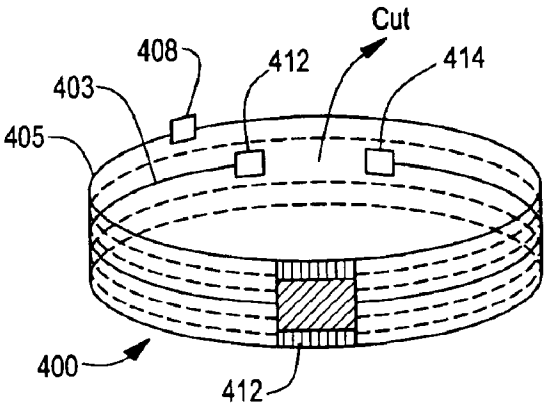
FIG. 16 is a schematic three-dimensional top view of a narrow band of the tubular fabric system of this invention showing a plurality of sensors connected on distinct left and right side of the narrow band.

Narrow band 400, FIG. 16, of similar designs to narrow band 102, FIG. 9B includes plurality of conductive yarns 401, 403, and 405. In this example, sensors 408 is connected to continuous conductive yarn 403 while sensors 412 is connected to cut conductive yarn 403. Cutting conductive yarn 403 provides the ability to attach sensor 412 on the left side of narrow band 400 and attach sensor 414 on the right side of band 400 which, as discussed above, improves measurement of physiological vital signs. Narrow band 400 may also include electric unit 412, which performs a similar function as electric unit or device 142, FIG. 13 or electric unit 210, FIG. 14.

Figure 17:
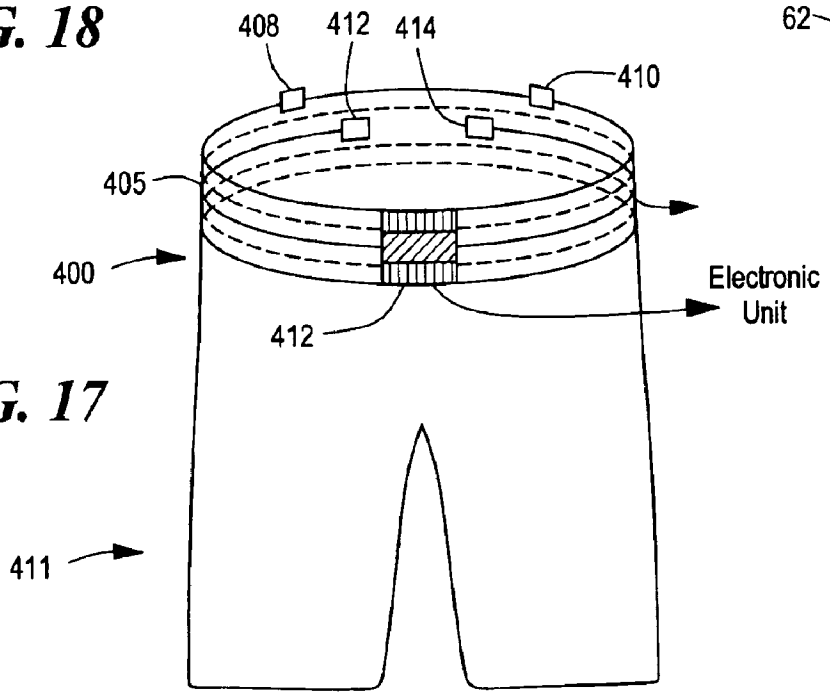
FIG. 17 is a schematic three-dimensional view of the narrow band of the tubular fabric system shown in FIG. 16 incorporated into a pair of running pants.

Narrow band 400 with sensors 408 and/or sensors 412 and 414 may be sewn into running pants 411 as shown, FIG. 17. In other examples, narrow band 400 with sensors 408, 410, and/or sensors 412 and 414 may be sewn into a bra or any other garment, such as socks, gloves, T-shirts, hats, and the like.

Figure 18:
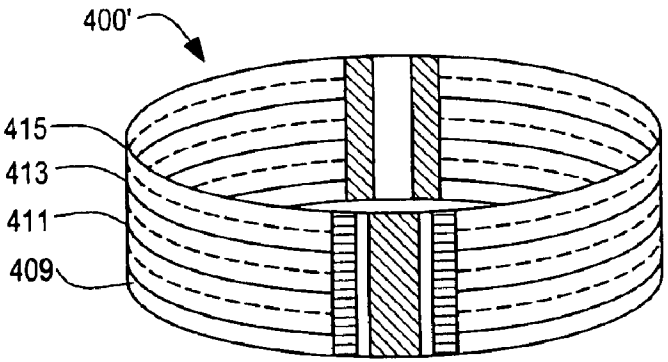
FIG. 18 is a schematic three-dimensional view of the narrow band of the tubular fabric system showing a plurality of conductive yarns connected in parallel to decrease the electrical resistance to reduce impedance.

Narrow band 400', FIG. 18 includes plurality of conductive yarns 409, 411, 413 and 415 in a parallel configuration for decreasing electrical resistance, as described above.

Figure 19:
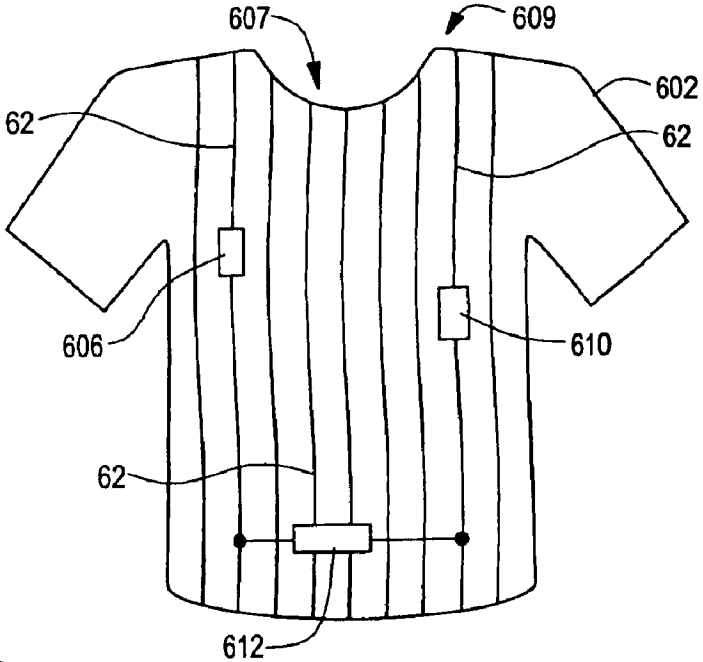
FIG. 19 is a schematic front view of the tubular knit fabric of this invention in which the continuous spiral configuration is longitudinally orientated in a shirt and further showing a plurality of sensors attached to left and right sides of the shirt.

In one embodiment, tubular knit fabric 56, FIG. 6 is radially cut in large sections, such as at line 600, to create large sections of tubular fabric sleeve 58 which are then orientated in a vertical manner to manufacture a garment. For example, shirt 602, FIG. 19, includes functional yarn 62 (conductive yarn) longitudinally configured. Sensor 606 may be connected to conductive yarn 62 on the left side of shirt 602. Cutting neck segment 607 breaks the continuous spiral configuration 66 (not shown) in the neck segment 607, however, continuous spiral configuration 66 begins again after neck segment 607, as indicated at 609. Sensor 610 may be connected to conductive yarn 62 on the right side of shirt 602. This feature, as discussed above, provides for the measurement of physiological activities which incorporate physiological vital signs from the left and right sides of the body. Monitoring device or sensor 612 may span two conductive yarns sections of conductive yarn 62 which results in a redundancy of conductive yarn 62.

Figure 20:
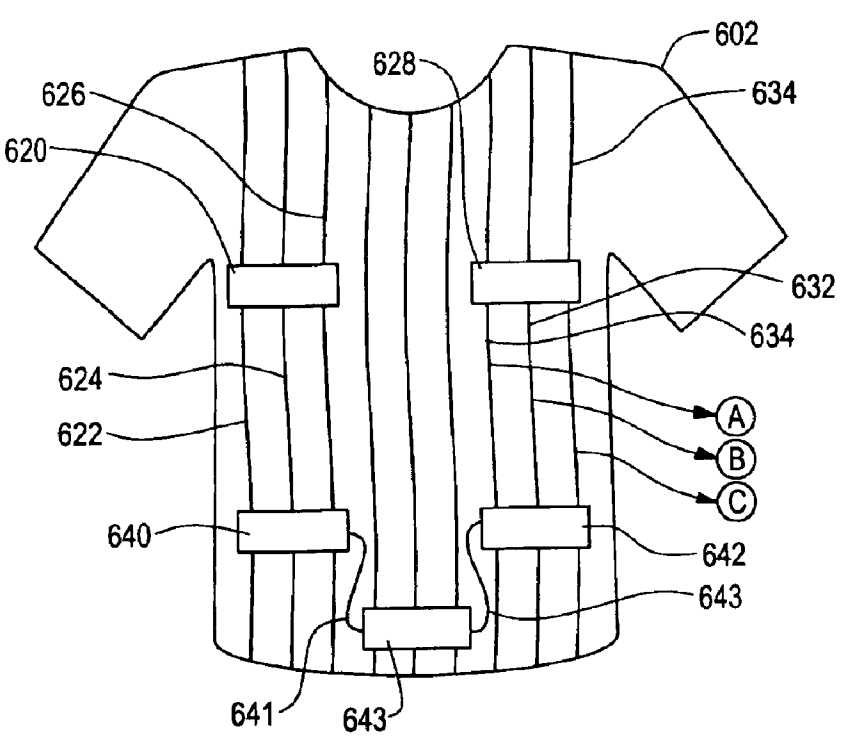
FIG. 20 is a schematic front view of the shirt shown in FIG. 19 showing a plurality of sensors connected to a plurality of conductive yarns used to reduce impedance and/or for the measurement of physiological vital signs.

Shirt 602, FIG. 20, shows several example placements and configuration of sensors on shirt 602. In this example, sensor 620 located on the top left of shirt 602 and spans three separate conductive yarns 622, 624, and 626. Sensor 628, located on the top right of shirt 602, spans three separate conductive yarns 630, 632, and 634. Sensors 640 and 642, which span conductive yarns 622–626 and 630–634, respectively, are located on the bottom right and left, respectively, of shirt 602. In this example, electrical monitoring device 643 interconnected and communicates to sensors 640 and 642 via leads 641 and 643.

Figure 21:
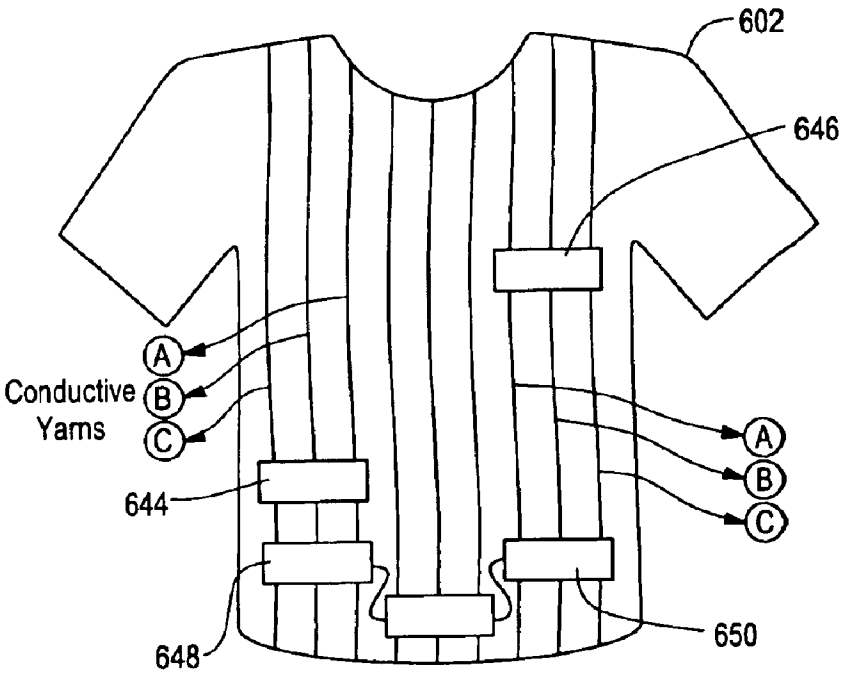
FIG. 21 is a schematic front view of the shirt shown in FIG. 19 showing several exemplary locations and configurations of the plurality of sensors mounted on the shirt.

FIG. 21 shows another example of sensor placement and configuration on shirt 602. In this example, sensors 644 and 648 are located on the bottom left of shirt 602. Sensor 646 is located on the top right and sensor 650 is located on the bottom right. Various sensor locations provide the ability to have controlled impedance and redundancy to measure physiological signals such as for heart rate and the like, in a more accurate and reliable manner. Those skilled in the art will recognize that any number of sensors can be placed in any number of locations.

Figure 22:
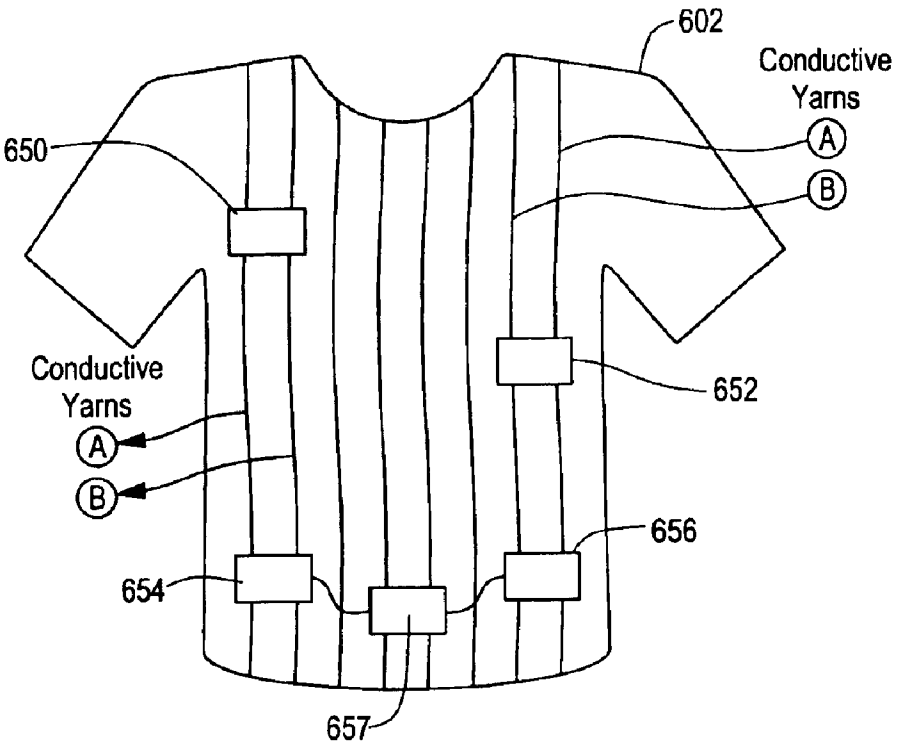
FIG. 22 is a schematic back view of the shirt shown in FIG. 19 showing several exemplary locations and configurations of the plurality of sensors mounted on the shirt.

FIG. 22 shows an example of sensor placement on the back side of shirt 602. In this example, sensor 650 is located on the top left of the back of shirt 602, sensor 652 is located on the middle right of the back of shirt 602, terminal 654 is located on the bottom left of the back of shirt 602, and sensor 656 is located on the bottom right of shirt 602. In FIG. 22 both terminals are connected to a monitoring device 657.

Figure 23:
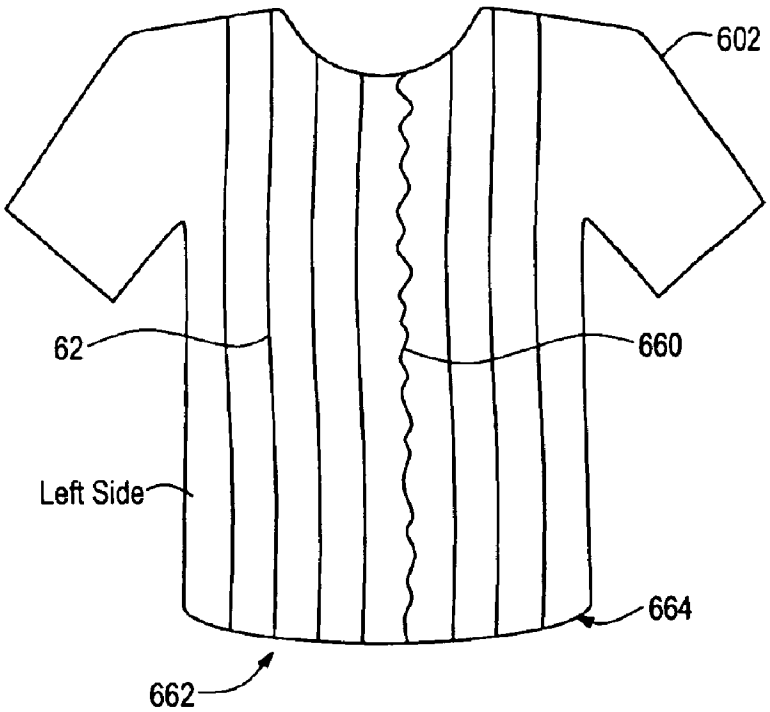
FIG. 23 is a schematic front view of a shirt shown in FIG. 19 manufactured to include a zipper.

In one design, shirt 602, FIG. 23 includes fastening device 660 (e.g., a zipper). In this unique embodiment, zipper 660 can be incorporated into the design of shirt 602 because conductive yarn 62 and continuous spiral configuration 66 is orientated vertically along shirt 602. Hence, the addition of zipper 660 results in two separate sections of conductive yarn 62, as indicated at 662 and 664.

Figure 24:
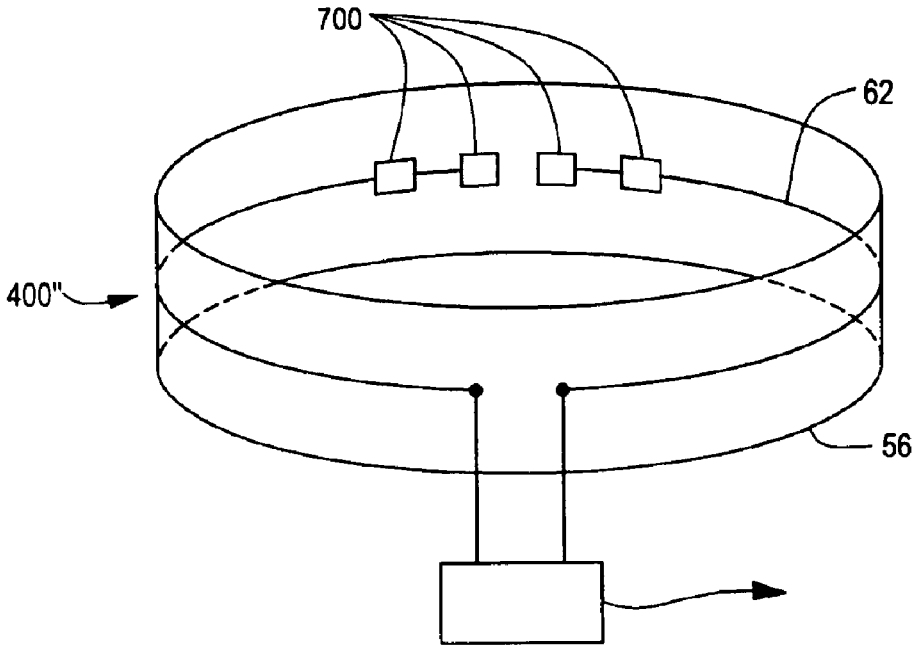
FIG. 24 is a schematic three-dimensional view of the narrow band of the tubular knit fabric system of this invention utilizing a plurality of sensors connected in series on the conductive yarn.

FIG. 24 shows an example of narrow band 400" of tubular knit fabric 56 including plurality of sensors 700 connected to conductive yarn 62 to provide redundancy of sensors on the same network infrastructure (e.g., conductive yarn 62). If one of the plurality of sensors 700 malfunctions, the remaining sensors will remain running.

Figure 25:
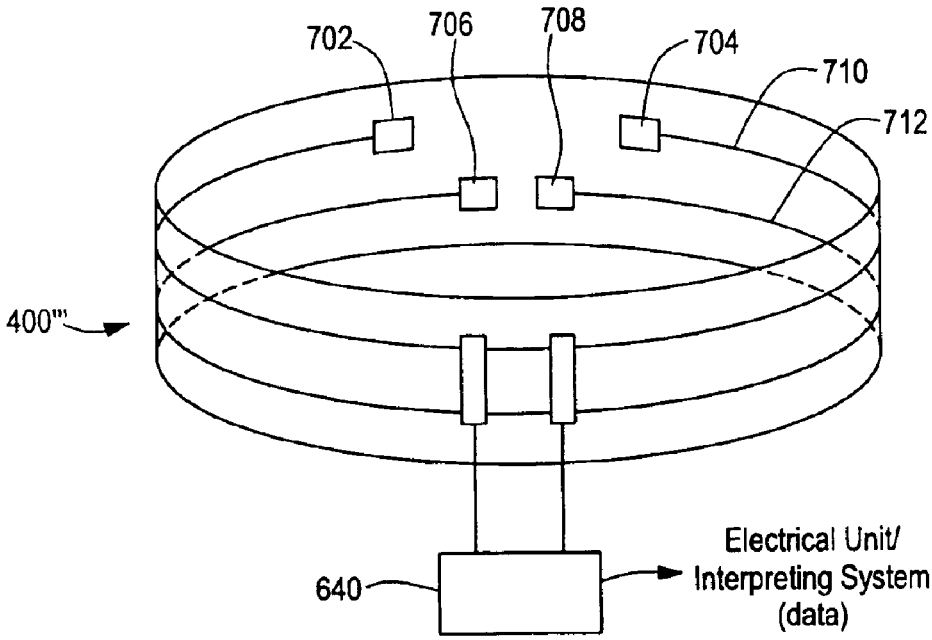
FIG. 25 is a schematic three-dimensional view of the narrow band of the tubular knit fabric system shown in FIG. 24 employing a plurality of sensors connected to a plurality of conductive yarns.

In another design, narrow band 400'", FIG. 25 includes a plurality of sensors 702, 704, 706, and 708 connected to plurality of conductive yarns 710 and 712. In this example, sensors 702 and 704 are connected on conductive yarn 710, and sensors 706 and 708 are connected to conductive yarn 712, hence providing a reduction in the number of sensors and conductive yarns.

Figure 26:
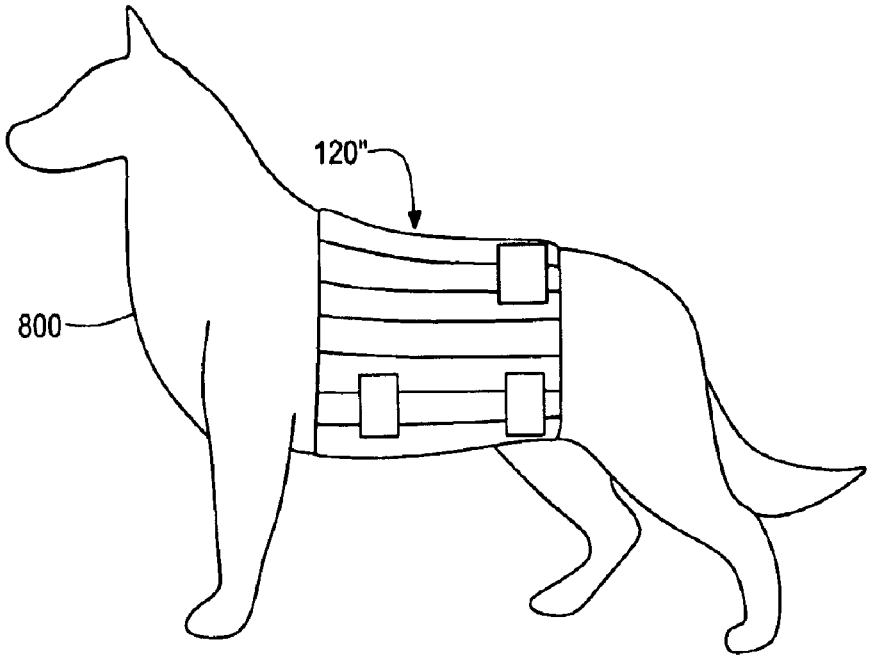
FIG. 26 is a schematic side view showing the tubular knit fabric system of this invention monitoring the physiological activities of an animal.

The tubular knit fabric system of this invention is not limited to measuring the physiological activity of humans. In one embodiment, tubular knit fabric system 120", FIG. 26 can be used for monitoring the physiological activity of animals, such as dog 800, birds, snakes, ants, turtles and the like.

Figure 27:
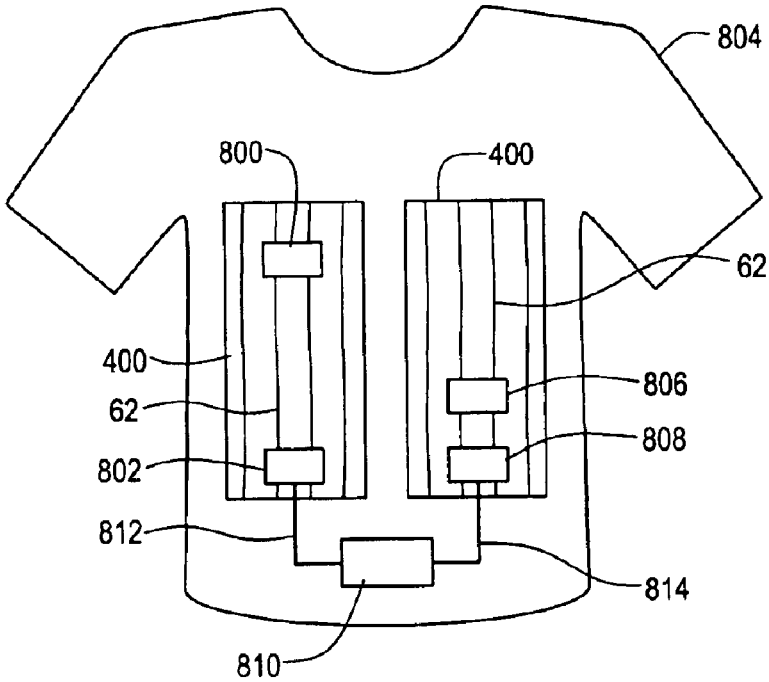
FIG. 27 is a schematic front view showing the narrow band of the tubular knit fabric system shown in FIGS. 24 and 25 attached to a shirt.

In another embodiment of this invention, narrow band 400$^{IV}$, FIG. 27 including sensor 800 and terminal 802 connected to conductive yarn 62 is mounted on to shirt 804 to provide for monitoring of physiological functions of the body. Similarly, narrow band 400$^{V}$ with sensor 806 and terminal 808 connected to conductive yarn 62 may be applied to the right side of shirt 804. Sensors 800 and 806, FIG. 27 communicate to electronic unit 801 via conductive leads 812 and 814 which maybe connected to terminals 802 and 808, respectively, and conductive yarn 62.

Figure 28B:
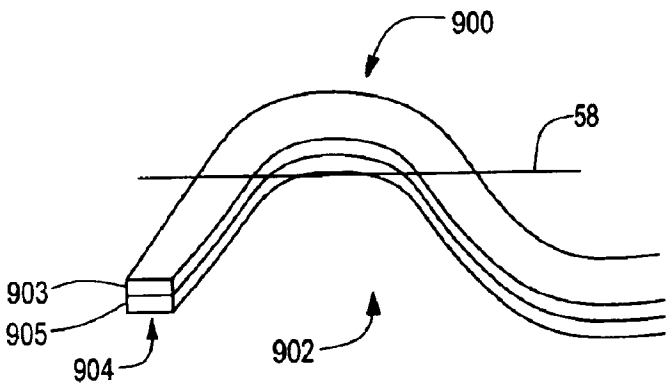
FIGS. 28A and 28B show one example of the function yarn employed as a thermo-electric yarn.
Figure 28A:
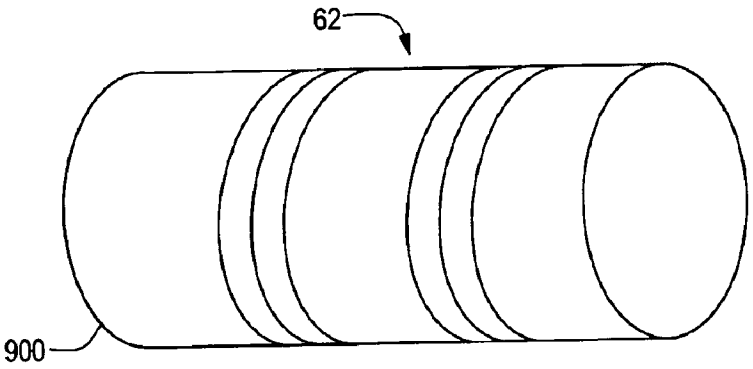

Function yarn 62, FIGS. 5–25, although typically used as a conductive yarn, may also be used as a thermo-electric yarn, a Lithium-ion battery yarn, or a solar yarn. For example, as shown in FIGS. 28A and 28B, function yarn 62 may be employed as thermo-electric yarn 900. Thermo-electric element 902, FIG. 28B is made by joining two doped semi-conducting materials together, such as n-type material 903 and p-type material 905. When current flows from n-type material 903 to the p-type material 905, the dominant carriers in both materials move away from the junction and carry away heat. The junction thus becomes cold because the electrical current pumps heat away from the junction. Thermo-electric element 902 is manufactured in a very narrow band 904 which is wrapped around an insulative yarn 58, or a conductive wire-like tinsel or stainless steel that can serve as a heat sink yarn and/or a power source.

Figure 29B:
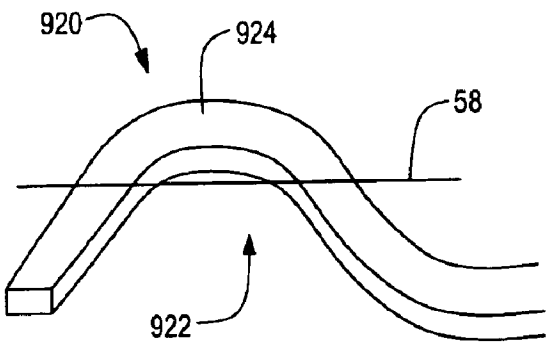
FIGS. 29A and 29B show an example of the function yarn employed as a Lithium-ion battery yarn.
Figure 29A:
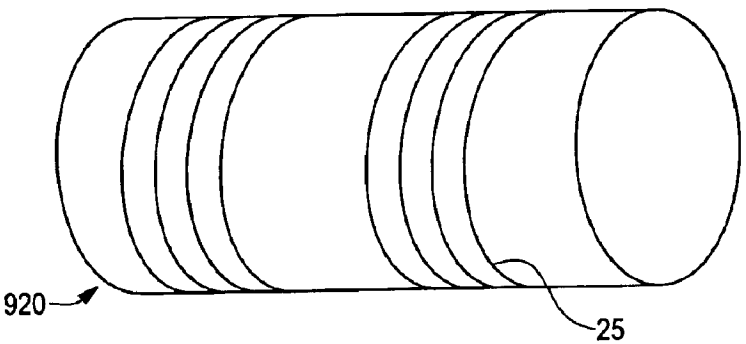

In another example, as shown in FIGS. 29A and 29B, function yarn 62 may be employed as Lithium-ion battery yarn 920. Lithium-ion battery element 922 is made of a very thin and narrow strip 924 which is wrapped around insulative yarn 58, or wrapped around a conductive yarn such as tinsel. Lithium-ion battery yarn 920 is knitted in the circular knitting in single jersey, double knit, reverse plating terry, terry, tricot and the like. Lithium-ion battery yarn 920 will self-energize the fabric with rechargeable Lithium-ion battery.

Other examples of function yarn 62 will occur to those skilled in the art, such as a solar yarn for the creation of magnetic fields, power generation.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims:

What is claimed is:

1. A tubular knit fabric comprising:

at least one insulative yarn;

at least one stretchable yarn; and at least one functional yarn, said insulating yarn, said stretchable yarn, and said functional yarn knitted together to define a tubular fabric sleeve having the functional yarn embedded in said tubular fabric sleeve in a continuous spiral configuration which longitudinally extends the length of said sleeve.

2. The tubular knit fabric of claim 1 wherein said functional yarn is an electrically conductive yarn.

3. The tubular knit fabric of claim 1 wherein said conductive yarn is made of a material chosen from the group consisting of: stainless steel, copper, alloy, copper plated with silver, core clad, a kevlar core, a filament core coated with silver, and conductive polymer.

4. The tubular knit fabric of claim 3 wherein said conductive yarn has an electrical resistance of 0.01 ohm/meter to 5,000 ohm/meter.

5. The tubular knit fabric of claim 1 wherein said insulative yarn is made of synthetic fibers and/or natural fibers and/or regenerated fibers made of a material chosen from the group consisting of: polyester, nylon, wool, rayon, cotton, silk, linen, polypropylene and acrylic.

6. The tubular knit fabric of claim 1 wherein said stretchable yarn is made of a material chosen from the group consisting of: spandex, and elastomeric yarn.

7. The tubular knit fabric of claim 1 in which said fabric stretches longitudinally and radially.

8. The tubular knit fabric of claim 1 in which said fabric is used to manufacture a garment.

9. The tubular knit fabric of claim 8 in which said garment is seamless.

10. The tubular knit fabric of claim 9 in which said functional yarn is spaced in a predetermined spacing in a predetermined section of said garment.

11. The tubular knit fabric of claim 8 in which said garment is chosen from the group consisting of: shirt, pants, jacket, bra, underwear, sock, stocking, knee brace, and/or arm brace, and/or leg brace.

12. The tubular knit fabric of claim 9 in which said garment is chosen from the group consisting of: shirt, pants, jacket, bra, underwear, sock, stocking, knee brace, and/or arm brace, and/or leg brace.

13. The tubular knit fabric of claim 1 further including a plurality of insulative yarns, a plurality of said stretchable yarns, and a plurality of said functional yarns.

14. The tubular knit fabric of claim 10 wherein said plurality of insulative yarns, said plurality of stretchable yarns, and said plurality of conductive yarns are knitted together in a repeating pattern to define said tubular fabric sleeve, said pattern including at least one functional yarn per pattern.

15. The tubular knit fabric of claim 14 wherein said plurality of insulative yarns, said plurality of stretchable yarns, and said plurality of conductive yarns are knitted together in a plated knit construction on at least one side of said tubular knit fabric.

16. The tubular knit fabric of claim 14 wherein said plurality of insulative yarns, said plurality of stretchable yarns, and said plurality of conductive yarns are knitted together in a plated knitted construction on both sides of the fabric, said fabric having an insulated yarn in between the stretchable yarn and the conductive yarn.

17. The tubular knit fabric of claim 15 wherein said plated knit construction is chosen from the group consisting of: single jersey, double-knit and ribs.

18. The tubular knit fabric of claim 1 wherein said tubular fabric sleeve is body sized.

19. The tubular knit fabric of claim 14 wherein said tubular fabric sleeve is body sized.

20. The tubular knit fabric of claim 14 wherein said pattern is a symmetric pattern of said plurality of insulative yarns, stretchable yarns and functional yarns.

21. The tubular knit fabric of claim 14 wherein said pattern is an asymmetric pattern of said plurality of insulative yarns, stretchable yarns and functional yarns.

22. The tubular knit fabric of claim 14 wherein said plurality of said functional yarns are electrically conductive yarns.

23. The tubular knit fabric of claim 11 wherein the said tubular fabric sleeve is radially cut to form a narrow band of tubular fabric.

24. The tubular knit fabric of claim 23 in which said narrow band of tubular fabric is attached to a garment.

25. The tubular knit fabric of claim 24 in which said garment is chosen from the group consisting of: a bra, running pants, shirts, underwear, socks, a hat, gloves, stocking, orthopedic support braces for the arms and legs.

26. The tubular knit fabric of claim 9 in which said seamless garment is knitted on a seamless knitting machine.

27. The tubular knit fabric of claim 1 wherein said functional yarn is used to transmit signals.

28. The tubular knit fabric of claim 1 wherein said functional yarn is used as a power pathway.

29. The tubular knit fabric of claim 2 wherein said electrically conductive yarn is used for generating heat.

30. The tubular knit fabric of claim 1 wherein said functional yarn is for thermo-electric cooling.

31. The tubular knit fabric of claim 1 wherein said functional yarn is a rechargeable battery.

32. A tubular knit fabric system, the system comprising:

at least one insulative yarn;

at least one stretchable yarn;

at least one conductive yarn, said insulating yarn, said stretchable yarn, and said conductive yarn knitted together to define a tubular fabric sleeve having the conductive yarn embedded in said tubular fabric sleeve in a continuous spiral configuration which longitudinally extends the length of said sleeve; and a device connected to said conductive yarn.

33. The system of claim 32 in which said device is a sensor for measuring physiological signs of the body.

34. The system of claim 32 in which said physiological signs measured are chosen from the group consisting of: heart rate, blood pressure, heart abnormalities, sweat rate, basal metabolic rate and temperature.

35. The system of claim 32 in which said sensor is a conductive electrode and/or an electrical circuit.

36. The system of claim 32 in which sensor is a conductive patch made of a material chosen from the group consisting of: resin, resin with embedded conductive particles, metal, copper, alloys, conductive rubber, and conductive epoxies.

37. The system of claim 32 in which said device connected to said conductive yarn is chosen from the group consisting of: a heart rate measuring device, a blood pressure measuring device, a temperature measurement device, a sweat measurement device, and a basal metabolic measuring device, an activity measurement device, a hydration measurement device, and a congnitivity measuring device.

38. The system of claim 32 further including terminals connected at the end and/or opposite ends of said conductive yarn.

39. The system of claim 38 in which an electronic unit is connected to said terminals, said electronic unit communicating to said device connected to said conductive yarn.

40. The system of claim 38 in which said electronic unit connected to said terminal is chosen from the group consisting of: a heart rate measuring device, a blood pressure measuring device, a temperature measurement device, a sweat measurement device, and a basal metabolic measuring device, an activity measurement device, a hydration measurement device, and a congnitivity measuring device, said electric unit connected to a garment by conductive rubber and/or sewing and/or mechanical snaps, and/or conductive epoxy or combination thereof.

41. The system of claim 32 further including a plurality of devices connected to said conductive yarn.

42. The system of claim 32 further including a plurality of devices connected to a plurality of conductive yarns.

43. The system of claim 32 in which one of said plurality of sensors is located on the right side of a garment and another of each said plurality of sensors is located on the left side of a garment for heart rate monitoring.

44. The system of claim 41 in which one of said plurality of sensors is located on the top of a garment and another of each said plurality of sensors is located on the bottom of a garment.

45. The system of claim 42 in which one of said plurality of sensors is located on the right side of a garment and another of each said plurality of sensors is located on the left side of a garment.

46. The system of claim 42 in which one of said plurality of sensors is located on the top left side of a garment and another of each said plurality of sensors is located on the bottom right side of a garment.

47. The system of claim 43 in which said garment is chosen from the group consisting of: a bra, running pants, shirt, underwear and socks, a hat, gloves, orthopedic brace, stocking and swimsuits.

48. The system of claim 44 in which said garment is chosen from the group consisting of: a bra, running pants, shirt, underwear and socks, a hat, gloves, orthopedic brace, stocking and swimsuits.

49. The system of claim 45 in which said garment is chosen from the group consisting of: a bra, running pants, shirt, underwear and socks, a hat, gloves, orthopedic braces, sleeves, swimsuits and stockings.

50. The system of claim 46 in which said garment is chosen from the group consisting of: a bra, running pants, shirt, underwear and socks, a hat, gloves, orthopedic braces, sleeves, swimsuits and stockings.

51. The system of claim 32 in which said system is incorporated into a garment chosen from the group consisting of: a bra, running pants, shirt, underwear and socks, a hat, gloves, orthopedic braces, sleeves, swimsuits and stockings.

52. The system of claim 32 wherein said tubular fabric sleeve having said conductive yarn embedded in said tubular fabric sleeve in a continuous spiral configuration which longitudinally extends the length of said sleeve, is radially cut and orientated in said garment such that the continuous spiral configuration extends vertically along the length of the garment.

53. An integrated data and power bus comprising:

at least one insulative yarn;

at least one stretchable yarn; and at least one functional yarn, said insulating yarn, said stretchable yarn, and said functional yarn knitted together to define a tubular fabric sleeve having said functional yarn embedded in said tubular fabric sleeve in a continuous spiral configuration which longitudinally extends the length of said sleeve.

54. A tubular knit fabric comprising:

at least one insulative yarn;

at least one stretchable yarn; and at least one functional yarn, said insulating yarn, said stretchable yarn, and said functional yarn knitted together to define a tubular fabric sleeve, having the functional yarn embedded said tubular fabric sleeve in a continuous spiral configuration which longitudinally extends the length of said sleeve; said tubular fabric sleeve radially cut and orientated such that the continuous spiral configuration extends vertically along the length of a garment.

55. A tubular knit fabric comprising:

at least one insulative yarn;

at least one stretchable yarn; and at least one functional yarn, said insulating yarn, said stretchable yarn, and said functional yarn knitted together in a plated knit construction to define a tubular fabric sleeve having the functional yarn embedded in said tubular fabric sleeve in a continuous spiral configuration which longitudinally extends the length of said sleeve.

56. A tubular knit fabric comprising:

at least one insulative yarn;

at least one stretchable yarn; and at least one functional yarn, said insulating yarn, said stretchable yarn, and said functional yarn knitted together in a plated knit construction to define a seamless tubular fabric sleeve having the functional yarn embedded in said tubular fabric sleeve in a continuous spiral configuration which longitudinally extends the length of said seamless tubular fabric sleeve.

57. A method for manufacturing a tubular knit fabric, the method comprising:

providing at least one insulative yarn;

providing at least one stretchable yarn;

providing at least one functional yarn; and knitting said insulative yarn, said stretchable yarn and said functional yarn together to define a tubular fabric sleeve having the functional yarn embedded in said tubular fabric sleeve in a continuous spiral configuration which longitudinally extends the length of said sleeve.

* * * * *